United States Patent [19]

Del Principe et al.

[11] 4,403,777

[45] Sep. 13, 1983

[54] ELECTRONIC GAME USING PHOTOTRANSDUCER

[75] Inventors: Robert M. Del Principe, Hawthorne; David A. Hostetler, Torrance; John Ling, Hacienda Heights, all of Calif.

[73] Assignee: Mattel, Inc., Hawthorne, Calif.

[21] Appl. No.: 223,537

[22] Filed: Jan. 8, 1981

[51] Int. Cl.[3] ..... A63F 9/00

[52] U.S. Cl. ..... 273/313; 273/1 E; 273/1 GC

[58] Field of Search ..... 372/310–313, 372/1 GC, 1 GE, 1 E, 85 G, 237; 356/29; 434/21, 22; 340/168 B, 825.69; 455/352

[56] References Cited

U.S. PATENT DOCUMENTS

| | | | |
|---|---|---|---|
| 3,508,751 | 4/1970 | Meyer et al. | 273/310 |
| 3,898,747 | 8/1975 | Marshall | 434/22 |
| 4,171,811 | 10/1979 | Meyer et al. | 273/310 |
| 4,281,833 | 8/1981 | Sandler et al. | 273/85 G |
| 4,315,689 | 2/1982 | Gioda | 434/22 |

FOREIGN PATENT DOCUMENTS

| | | | |
|---|---|---|---|
| 2041594 | 9/1980 | United Kingdom | 273/313 |

OTHER PUBLICATIONS

*Applied Optics*, vol. 51, pp. 1127–1130, Westinghouse Electric Corporation, "Comparison of Infrared Tracking System", 4/19/60.

*Primary Examiner*—Vance Y. Hum
*Assistant Examiner*—Mary Ann Stoll
*Attorney, Agent, or Firm*—John G. Mesaros; Ronald M. Goldman; Max E. Shirk

[57] ABSTRACT

An electronic game utilizing a phototransducer and a plurality of input switches as inputs to a microprocessor for actuating a display and speaker for providing visual and audible clues to a user in accordance with internally generated signals. The processor estabilishes light sensitivity levels for comparison with incident light levels on the phototransducer for processing by the processor in accordance with the timing and duration of actuation of the input switches.

16 Claims, 14 Drawing Figures

| AUDIO PATTERN (PULSE) | DESCRIPTION | MEANING |
|---|---|---|
| RANGE SELECTED; NO OTHER BUTTONS PUSHED  TIME | A SERIES OF BEEPS WITH SMALLER GAPS BETWEEN PULSES | THE ALIEN IS GETTING CLOSER |
| SEARCH BUTTONS PUSHED:  TIME | AN EVEN PULSE OF A HIGH OR LOW TONE | HIGH PITCH TONE: VERY CLOSE OR RIGHT ON TO THE ALIEN. LOW PITCH: HAVEN'T FOUND IT YET |

ELECTRONIC GAME USING PHOTOTRANSDUCER

BACKGROUND OF THE INVENTION

The background of the invention will be discussed in two parts:

Field of the Invention

This invention relates to electronic games and more particularly to an electronic game utilizing a phototransducer and input switches in conjunction with a display and speaker.

Description of the Prior Art

With the advent of microprocessors and integrated circuit technology combined with large volume low cost availability, electronic games, and more particularly handheld electronic games have become very popular as a source of amusement.

One type of handheld electronic game in the form of a "football" game is shown and described in U.S. Pat. No. 4,162,792 entitled "Obstacle Game" issued July 31, 1979 to Chang, et al. In that game, a display is arranged in an array of segments of nine each in three rows simulating a portion of a football field with a plurality of input switches being provided for controlling the electronic positioning of an illuminated segment relative to other illuminated segments.

Other electronic games have been developed in the form of rifles utilizing photocells or phototransducers in conjunction with light emitting sources for simulating a shooting gallery type game.

It is an object of the present invention to provide a new and improved electronic game.

It is another object of the present invention to provide a new and improved handheld electronic game utilizing a phototransducer for sensing incident and ambient light as part of the play of the game.

It is a further object of the present invention to provide a new and improved electronic game for simulating a science fiction play theme.

SUMMARY OF THE INVENTION

The foregoing and other objects of the invention are accomplished by providing a handheld housing having a microprocessor and other electronics therein for receiving a plurality of input signals through input switches for actuating a display and speaker. A phototransducer is contained within the housing for receiving incident and ambient light from the environment in the direction at which the housing is pointed. The microprocessor internally generates a light sensitivity level for comparison with the electrical output of the phototransducer for providing an input to the microprocessor which is acted upon in accordance with the sequence and time duration of depression of one or more input switches. Sounds are emitted through the speaker for providing "clues" of the relative proximity of an "alien", with these audible signals being utilized by the operator in determining which switches should be actuated and in what sequence. Visual indications of success or failure are also provided by a display to thus assist the user in the decision making process. In a first embodiment a differential comparator is provided externally of the microprocessor while in a second embodiment the function is performed internal to the microprocessor.

Other objects, features and advantages of the invention will become apparent from a reading of the specification when taken in conjunction with the drawings, in which like reference numerals refer to like elements in the several views.

DESCRIPTION OF THE PREFERRED EMBODIMENT

Figure 1:
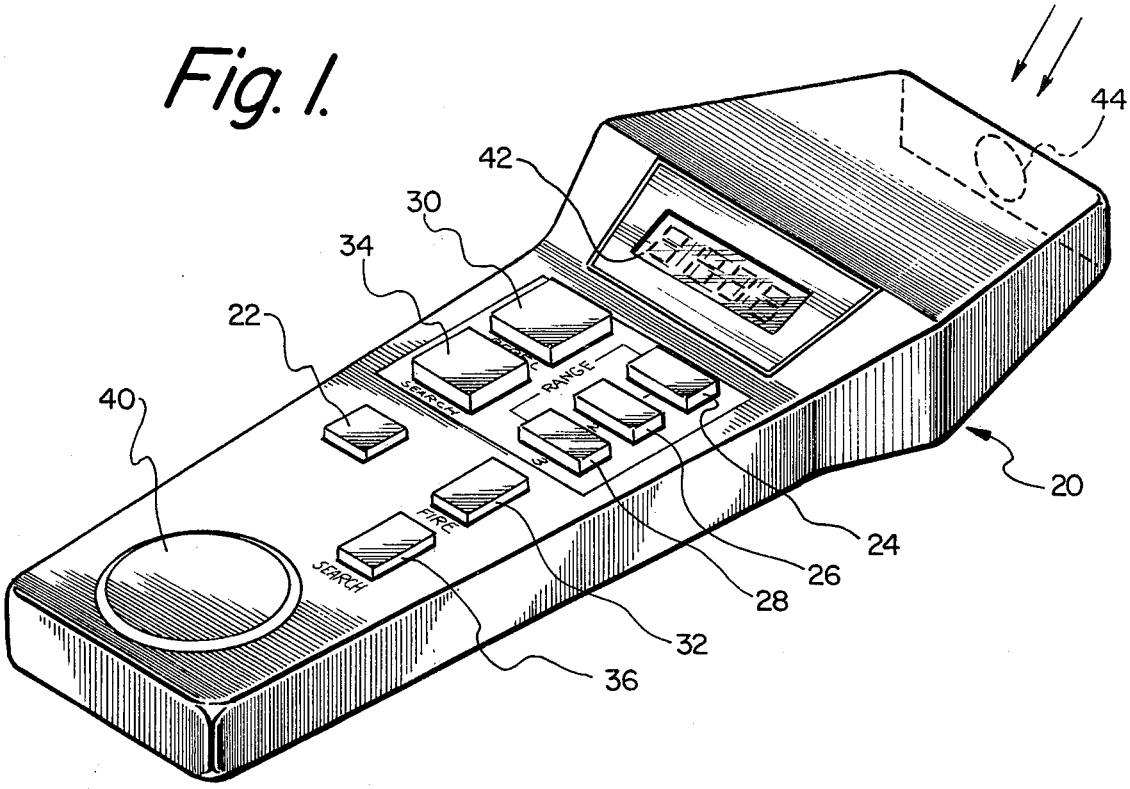
FIG. 1 is a perspective view of the hand-held electronic game according to the invention.

Referring now to the drawings and particularly to FIG. 1, there is shown a hand-held electronic game generally designated 20 which is configured for grasping by the two hands of the user. The game 20 is configured as a science fiction type weapon or "neutralizer" with the game format including use of the game 20 to search for hidden or invisible "aliens".

In use, the game 20 includes a plurality of switches, these switches being an on-off switch 22, range selection switches 24, 26 and 28, a "repel" switch 30, a "fire" switch 32, and a pair of "search" switches 34 and 36 on opposite sides of the longitudinal axis of the game 20 for use by both hands.

The game 20 makes provision for audible and visual indications to the user or operator of the nearness or proximity of an invisible "alien", these indications being provided by a speaker member 40 and a digital display 42 contained within the housing of the game 20.

Briefly, the electronic game 20 includes a microprocessor for receiving signals from the switches and for providing visual and audible indication in response to visible ambient or incident light impacting on a phototransducer 44 (shown in dotted lines) adjacent the forward end of the game 20. As will hereinafter be described, the microprocessor randomly generates a light sensitivity level which is used for comparison purposes to compare the incident light to alter the audible signals emitted from the speaker 40 to provide the user with an indication of the distance to the "alien" or the direction of the "alien". The display 42, upon initiation of the game, displays an "energy level" of the "neutralizer" with energy being drained during a search mission, and the energy being restored upon neutralization of an alien.

In accordance with the rules of the game, the format for the play of the game is structured in the following manner. Invisible alien beings are invading the earth. They steal and feed off of the earth's power systems.

Earth's only protection from these alien beings is a hand-held detector or neutralizer 20 which is needed to find and destroy them. Since the aliens are attracted to power, they "home in" on the device. If an alien should reach it, the alien will latch on taking all the power from the device. This would render it useless and allow more aliens to sneak by. Aliens come in groups of four at a time with each alien having a level of strength assigned by the program in the microprocessor, such as from "1" to "4".

During play of the game, the switch 22 is turned to the on position and one of the "range" switches 24, 26 or 28 is depressed after which a numerical or visual indication of an "energy" level appears on the display 42. If the search switches 34 and 36 are not depressed, an audible sound or "heartbeat" will be emitted, the frequency of the sound being unrelated to ambient light. Then with depression of the search switches and depending upon the incident light impacted on the transducer 44, audible sounds will be emitted from the speaker 40 as modified by this light. The user then points the device or game 20 in various directions which, dependent upon the light then impacting on the transducer 44, will vary the audible sound emitted from the speaker 40 as well as information on the display 42. An important phase of the game is the user's ability to interpret the sounds emitted from the speaker 40. During this search phase, the energy level (although not shown on the display 42) will commence counting down internally within the microprocessor 50. At the time the user interprets the audio signals from the speaker 40 and information on the display 42 as indicating the presence of an alien, the user then depresses the "fire" button 32. Upon releasing the search buttons 34 and 36, the display will indicate energy which value decreases during depression of the fire button 32. Depending upon whether a "hit" or "miss" is effected, the numerical energy indication on the display 42 will increase or decrease accordingly. As an alternative to firing, the user may depress the "repel" button 30 which causes an instant energy loss. If the operator lifts the thumbs or fingers from the "search" switches 34 and 36, the energy level displayed on the display 42 will start building up prior to the next attempt. With each successful search and neutralize mission, energy will be added with this energy being indicated on the display 42. Game success is determined by the numerical indication on display 42 after the search and neutralization of the four aliens. These game rules and game play will be discussed in more detail hereinafter.

Figure 2:
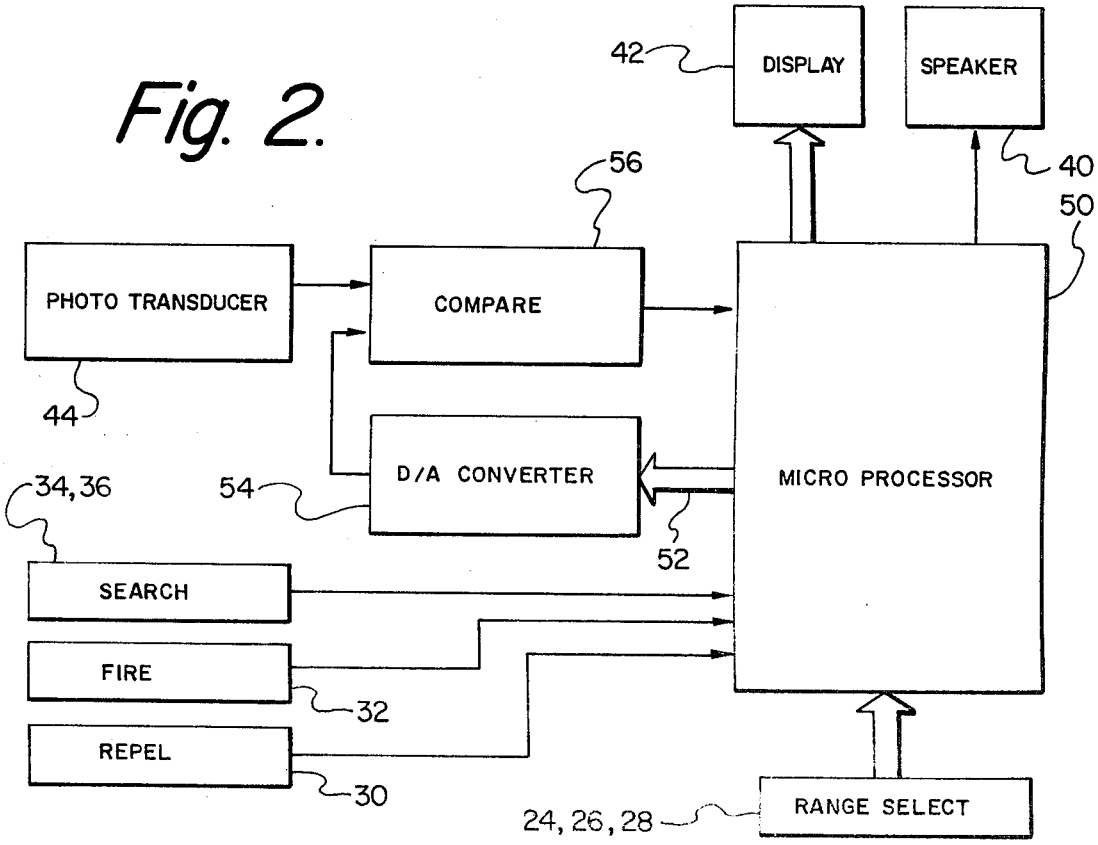
FIG. 2 is a functional block diagram of a first embodiment of the electronic portion of the electronic game of FIG. 1.

Referring now to FIG. 2, there is shown in block diagram form the electronics associated with the game 20, these electronics including a microprocessor 50. Where applicable, certain elements of the block diagram of FIG. 2 will bear the same reference numerals as the corresponding elements previously described in conjunction with FIG. 1. The arrows between blocks in the diagrams are illustrated as single line where a single signal is used and as a two-dimensional arrow where a group of lines or conductors provide the appropriate inputs or outputs. Additionally, certain functions are depicted with two or three reference numerals, these being "search" with reference numerals 34 and 36 since two switches are provided and the "range select" function with reference numerals 24, 26 and 28 since three switches are provided. In actual practice the "search" mode requires depression of both switches 34 and 36 to perform the function, thus requiring both hands of the user on the game 20 to avoid the use of one hand by the user to shade the phototransducer 44 which would vary the outcome of the game undesirably.

The microprocessor 50 receives input signals from the "range select" switches 24, 26 and 28; from the search switches 34 and 36; from the "fire" switch 32 and the "repel" switch 30. Depending upon the status of the so-selected switches and internally generated parameters, digital pulses are transmitted over a cable 52 to a digital-to-analog converter 54 which provides a first input to a comparator 56, the other input of which is received from a phototransducer 44. The output of the comparator 56 is then transferred back to the microprocessor 50 for further processing. The output appearing on the cable 52 to the digital-to-analog converter 54 will be a digital representation indicative of a given light sensitivity level to which the comparator 56 responds as determined by the program within the microprocessor 50 and as modified by the manually depressible input switches. The microprocessor 50 then processes the data to provide outputs to the display 42 as well as the speaker 40 to enable the user to further modify the inputs based on the interpretation of the audible signals at the speaker 40 and the visual indication at the display 42.

Figure 3:
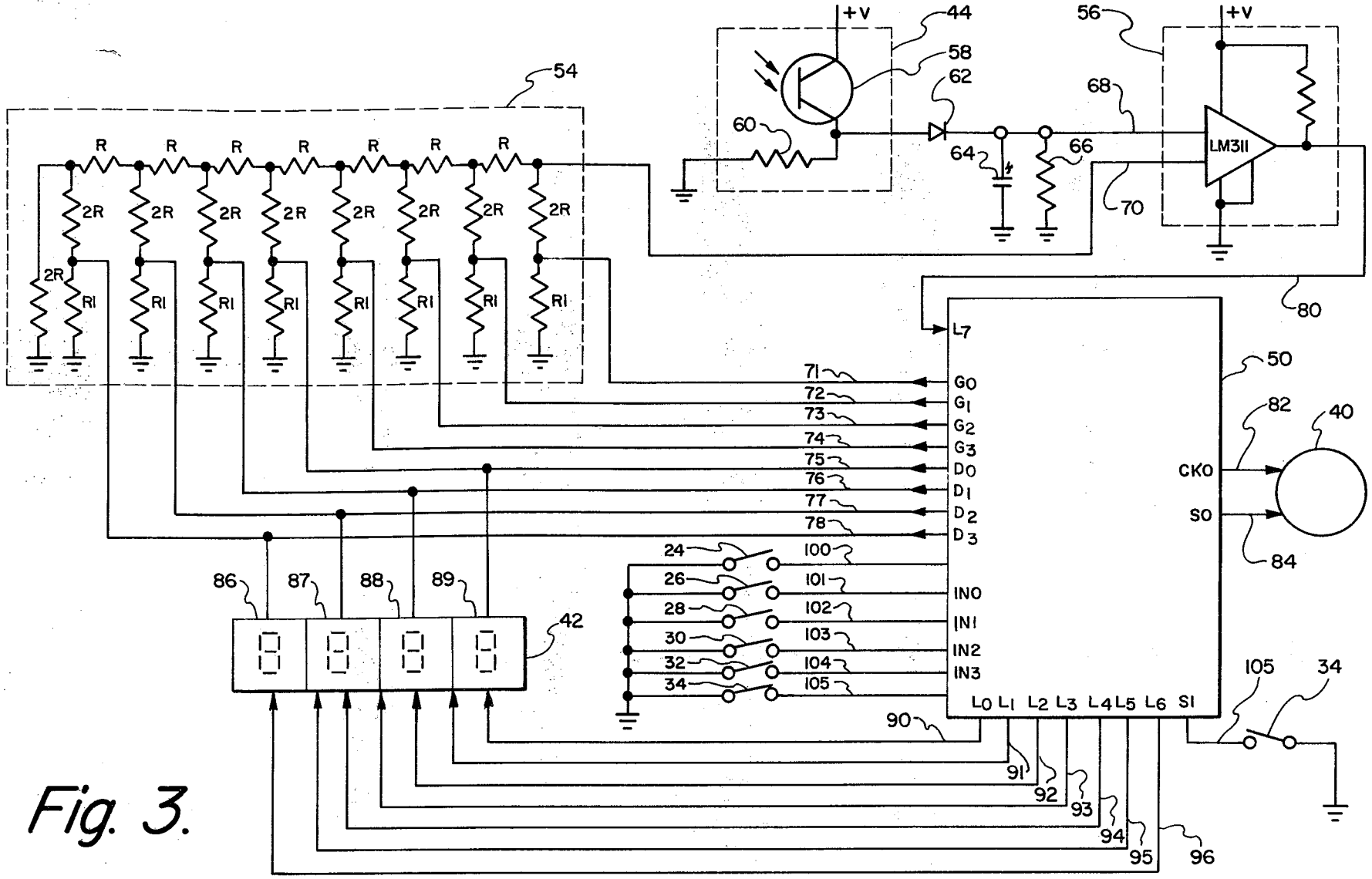
FIG. 3 is a schematic block diagram of a first embodiment of the electronic game of FIG. 1 showing the components external to the microprocessor.

FIG. 3 is a more detailed representation of the system of FIG. 2 with the microprocessor 50 shown as a rectangular block with the balance of the diagram representing schematically the inputs and outputs to and from the microprocessor 50. For convenience, certain portions of the schematic portion have been enclosed in dotted lines to show the functional equivalence to the system block diagram of FIG. 2, with these dotted line enclosures bearing reference numerals of the same function shown in FIG. 2. Similarly, the input switches are shown in schematic form bearing the same reference numerals as the corresponding functions in FIGS. 1 and 2.

The microprocessor 50 utilized in the preferred embodiment is of the type sold by National Semiconductor Corp. and is of the family referred to as the COP 410L/COP 411L single-chip N-channel microcontroller. Such a microprocessor includes, within the chip, all system timing, internal logic, read only memory, random access memory and input/output circuitry. The main difference between the microprocessor 50 and the COP 410L microcontroller is inclusion of additional input/output lines from the nineteen lines normally utilized to the twenty-two input/output lines utilized in the instant invention. A detailed description of the specifications of the COP 410L microcontroller may be found in the National Semiconductor Corp. publication DA-SFR25M10, copyrighted January, 1980 by National Semiconductor Corp. That publication is incorporated herein by reference for technical details related to the microprocessor 50.

The phototransducer portion 44 includes the phototransducer semiconductor 58 suitably biased between a positive source of voltage +V and ground through a resistor 60 with the output of phototransducer 44 being suitably rectified by a diode 62 and then filtered by means of capacitor 64 and resistor 66 to be provided as a first input signal over leads 68 to a differential comparator 56 (which may be of the type sold by Texas Instruments, Incorporated under the designation LM311), the comparator 56 being suitably biased between a positive source of voltage +V and ground. The other input lead 70 of the comparator 56 is connected to the digital-to-analog converter 54 which is essentially a resistance bridge network so connected to received digital signals which, when true, go to ground to effectively provide a plurality of resistance values between the input lead 70 and ground based on the digital representation appearing at the multiple inputs to the digital-to-analog converter 54. In the resistance bridge network within the dotted line representation of digital-to-analog converter 54, the resistors are designated by the symbols R, 2R, and R1 with the values assigned to these resistors being 100,000 ohms, 200,000 ohms, and 5,000 ohms respectively. Eight input leads, designated by reference numerals 71–78 inclusive, are provided to a digital-to-analog converter 54, each of these leads being connected to a respective output of the microprocessor 50. Four of these leads 75–78, as will be explained hereafter, are utilized for a dual purpose on a time-shared basis, one purpose of which is to provide digit select outputs to the display 42.

The resistance network includes seven resistors R plus a resistor 2R connected in series between input lead 70 and ground. Intermediate lead 70 and the first resistor R there is connected a voltage divider network consisting of resistor 2R and resistor R1 in series between the nodal point and ground with lead 71 being interconnected between resistor 2R and R1. Similarly, between the first and second resistors R a second identical voltage divider network is connected between the node and ground with lead 72 connected intermediate the two resistors of the voltage divider. Six more voltage dividers are provided with the midpoints thereof being connected respectively to the leads 73–78. With this arrangement, one or more resistors R1 may be selectively shunted by means of the negative going digital pulses appearing on one or more of the output leads 71–78 thus permitting selective variation of the input voltage appearing at input 70 in accordance with the total composite resistive value of the resistor network, this input signal on lead 70 providing an indication of a level of photosensitivity determined by the microprocessor 50. Depending upon the relative analog values appearing at input leads 68 and 70 of the comparator 56, an output signal will appear on lead 80, as "+", "−", or "0" depending upon the comparison and provide an input to the microprocessor 50. As is typical in such microprocessors, the inputs are periodically sampled and the outputs appearing on leads 71–78 will correspond in time duration to the sampling of the input appearing on lead 80 for determining further action by the microprocessor.

Briefly, the circuity including phototransducer 44, digital-to-analog converter 54 and differential comparator 56 establishes the means for determining the presence of an "alien" in accordance with a microprocessor selected light sensitivity level (appearing as digital outputs on leads 71–78) being compared with the incident light on the phototransducer semiconductor 58 for comparison by comparator 56 for providing the input signal over lead 80, this information being suitably processed by the microprocessor 50 for generating outputs over leads 82 and 84 for providing audible signals to speaker 40. The outputs on leads 82 and 84 are generated by "toggling", at rates determined by the microprocessor 50 for providing differing frequencies depending upon the comparison.

As previously described, the output leads 75–78 also serve to provide digital signals to the four-digit display 42 which includes four digit locations 86–89 of the seven-segment light emitting diode or liquid crystal display type segment arrangement. With seven segments, the numbers 0–9 may be generated. The digit selection is ordinarily accomplished on a multiplexing basis as is well understood in the art. The selection of particular segments for energization at a particular digit location while that digit location is energized, is accomplished by the segment select outputs over leads 90–96. Illumination of the segment of a given digit location occurs upon coincidence of energization of the digit select lead for that digit location as well as an appropriate seven-digit code appearing on leads 90–96 which provides the information for energizing the proper segments of the so-selected digit location. This information is transmitted in a given "window" of time with each digit location 86–89 being illuminated in sequence with the sequence being at a "flicker-free" rate. The information so displayed on the display 42 is selected by the microprocessor 50 in accordance with the rules of the game for providing visual indication of the "energy" level existing at a given point in time depending upon the sequence of events effected by the operator in depressing the relative operating switches.

Each of the input switches 24, 26, 28, 30, 32 and 34 is connected in series between ground and one of the inputs to the microprocessor 50 over the input leads 100–105, the net effect of depressing any of the input switches being to drive the respective input to ground.

With respect to the play of the game, as previously dicussed the game play is based on a science fiction setting with invisible aliens invading the earth to steal and feed from the earth's power systems. Earth's only protection from these beings is the handheld detector or game 20 which is used to find and destroy the aliens. The game rules provide, for a given game period, that there are four aliens, with each of the aliens having a level of strength, for example, from one to four. These levels of strength determine the amount of energy required to be expended by the detector in neutralizing to the alien.

The microprocessor 50 includes means for establishing a preset energy level at the commencement of the game; includes means for selecting the light intensity level to which the comparator circuit 56 will respond for each of the aliens; includes means for interpreting which switches are depressed and for what time duration for altering the visual and audio outputs from the display 42 and speaker 40 respectively; and includes timing means to determine the time duration relation of switch actuations.

The play of the game is divided into three parts, these being evaluation of the situation, finding the alien, and attempting to neutralize the alien. The game is over on one of three occurrences, these occurrences being the finding and neutralizing of the predetermined number of aliens (four in the instant embodiment), the expending of all energy (display 42 count goes to zero) prior to finding and neutralizing all aliens, or an alien reaching the unit and taking its energy. During the play of the game, the player's choices are dictated by visual and audio stimuli from the mumerical indication on the display 42 as well as the particular sound being emitted by the speaker 40.

When the switch 22 is turned to the "on" position, a display 42 will be provided by the microprocessor 50 with an energy level indication of zero. After one of the range switches 24, 26 or 28 is depressed, the processor 50 will then place an alien in the vicinity and display an energy level of, for example, "200" on the display 42. The microprocessor 50 will then randomly pick a beginning distance of the alien within certain limits, this randomly selected distance being provided as the time it takes the alien to reach the unit. The microprocessor 50 also selects a reference light level over leads 71–78 to the digital-to-analog converter 54 as a first input to lead 70 of the differential comparator 56. The processor 50 then begins adding energy units at a predetermined rate of, for example, three units per second to the numerical indication on the display 42.

A subroutine in the program will then generate audible signals by means of digital representations from the microprocessor 50 over leads 82 and 84 to the speaker 40, these audible signals providing a "distance" sound until the player presses the search switches 34 and 36. This sound is in the form of coded "beeps" or pulses, the significance of which must be determined by the player prior to the depression of any of the other switches. During the "search" phase a two note "heartbeat" becomes faster as the alien "approaches" (as time runs out). A high frequency audio signal, or series of beeps, indicates that the transducer 44 is pointed very close to the direction of the alien (the incident light impacting on the phototransducer 44 is very near the predetermined threshold level preset by the microprocessor over leads 71–78). A low frequency audio output indicates that the alien is not close (the disparity between the incident light and the predetermined light sensitivity setting is far apart in order of magnitude).

Figure 4:
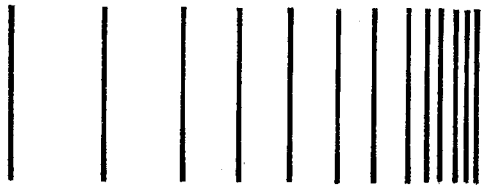
FIG. 4 shows in tabular form the audible signals of the game of FIG. 1 and the events causing these signals.
Figure 4:
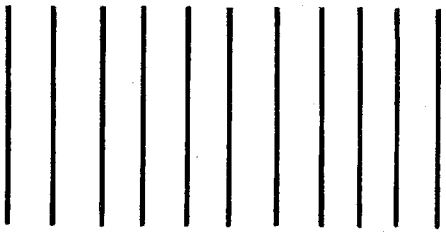

FIG. 4 illustrates in graphical and tabular form the coding of the "beeps" as well as the significance thereof in accordance with rules of the game. The upper portion of the graph illustrates in the "audio" pattern column a series of vertical lines indicative of individual pulses with the spacing between lines being indicative of the time duration between adjacent pulses with the second column describing the pulse pattern and the third column providing the meaning of that particular audio pattern. The upper portion of the graph illustrates the pulse pattern when one of the range switches 24, 26 or 28 has been depressed with no other switches pushed. The lower half depicts the results when the search switches 34 and 36 have been depressed with the pulse pattern being even and of a high frequency or low frequency indicating proximity of the alien. The upper portion of the graph of FIG. 4 essentially provides to the operator "distance" information while the more even pulse train of the lower portion of the graph provides "location" information to the operator.

After the device has been turned "on" the distance information is provided until the player presses the search switches 34 and 36. During the search phase the microprocessor 50 decrements a numeric value placed in a register indicative of the energy level, this decrementing being at a given rate such as four units per second. So long as the search switches 34 and 36 are depressed, this decrementing information will remain in the microprocessor 50 and will not be displayed on the display 42. The display 42 is blank when far from location, a number 1 to 4 (the size) when close and the number when right on. If the player lets up on the search switches 34 and 36, the game 20 will cease providing audio information about the location of the alien, will provide audio information about the distance of the alien (upper portion of graph of FIG. 4), and will change the value displayed on display 42 to an indication of the remaining energy level. With the search switches 34 and 36 not depressed, the energy level will then grow (or "recharge") at a rate determined by the program within the microprocessor 50 (established as a rate of three units per second). During this time the energy supply as shown on the display 42 will increase. While the player waits for the increase in the energy supply, the alien could capture the energy reserve from the game 20 (if time runs out).

During the "search" phase when the user attempts to find the alien, in accordance with the rules of the game both search switches 34 and 36 must be depressed to obtain location information (see bottom portion of FIG. 4), that is audio signals of an even pulse train, from the game 20. The player selects a range switch 24, 26 or 28 and after pressing search begins moving the game 20 around the environment. The player may point the detector at walls, in closets, away from windows, under furniture, or the like, until he receives a high frequency tone (an indication that he is pointed in the right direction). If no progress is made after a given amount of time, the player should depress another range switch 24, 26 or 28 and continue the search. During this searching mode, the incident light on transducer 44 is being constantly compared with the predetermined microprocessor controlled light sensitivity level.

When the visual display and the audible signals emitted from the speaker 40 indicate to the player that the alien is lined up, the player must move quickly into the next phase to prevent losing contact with the alien. While holding the device or game 20 pointed directly and steadily at the alien, the player depresses and holds down the fire switch 36. At this point, the energy level stored in the microprocessor 50 counts down at a predetermined rapid rate, of approximately sixty units per second, and "fire" sounds are emitted from the speaker 40. The player holds down the fire switch 36 until he has expended what he believes is enough energy to neutralize the alien, with this belief being based on the player's estimation of the closeness of the alien, and the strength of the alien as interpreted by the player based on the number previously viewed on the display 42. Generally, the closer an alien is, the less energy need be expended to neutralize it. After a neutralization attempt, that is depression and release of the fire switch 32, one of three conditions will occur: (1) the alien will be neutralized indicating a concurrence of a compare output on lead 80 accompanied by the holding down of the fire switch 32 for a time duration consistent with the preloaded alien strength level, the microprocessor program will generate a victory signal sequence of pulses to the speaker 40, the microprocessor program will increase the energy level on the display 42 to a higher number (indicating absorption of the alien's strength), for example, an additional value of fifty units times the strength level of the alien and the microprocessor will initialize itself to a different light sensitivity level and range providing another alien at a different location and distance which will then stalk the detector of the game 20; (2) the alien will be stunned, this event occurring when a zero output exists on lead 80 from the comparator 56 but the time duration of depression of the fire switch 32 is not consistent with the preloaded alien strength, the microprocessor will disable the sound output from speaker 40 for approximately one second indicating stopping of the alien, after which the alien will run away and not be replaced, however, during this one second interval the player can depress the fire switch 32 again while pointing in the same direction but must depress it for a time duration longer than the first time to effect a "hit", but if the alien is simply stunned the energy level depicted on display 42 will not be increased but will remain at the energy level remaining; or (3) the alien will have been missed, this event occurring when a zero signal is not emitted from the comparator 56 (actual light is above or below reference light) over lead 80 to the microprocessor 50, under some circumstances the player moves the detector housing of game 20 away from the alien before pressing the fire switch 32 or misinterpreted the audible signals, the player must either then wait for the energy level to rebuild or begin searching if he feels he still has enough energy remaining, and in the event of the miss the audible signals emanating from the speaker 40 continue as if nothing had happened. The alien may also run away if located during search and not fired on.

Figure 5:
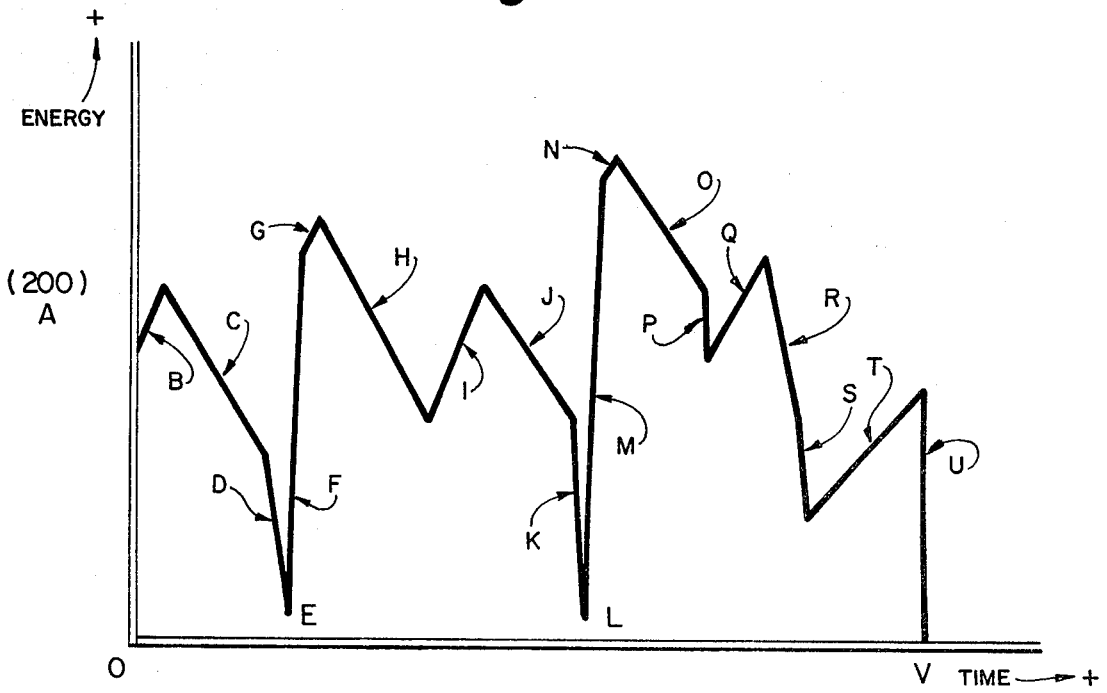
FIG. 5 is a graphical representation of energy levels during play of the game of FIG. 1.

Referring now to FIG. 5, there is shown in graphical form the "energy" level (in numerical indication on the display 42) versus time during play of a given game sequence. Various portions of the graph have been designated with alphabetical reference designations. The play of the game will be described hereinafter with reference to the alphabetical reference followed by a description of the events occurring and applying to that particular portion of the graph or curve.

A. This particular portion of the graph indicates the start of the game when the "on/off" switch 22 is actuated with the display 42 indicating zero.

B. When one of the range select switches 24, 26 or 28 is depressed, an initial energy is displayed (200 units) and the microprocessor 50 initiates a "build up" of energy at a predetermined rate as indicated by the slope of the curve portion B on the graph of FIG. 5.

C. When the search buttons 34, 36 are depressed, the "energy" begins to decrease as depicted by the slope of the curve section designated "C" with the slope of the curve depicting the relative rate of loss of energy, in this particular game a selected value is four units of energy per second.

D. This portion of the curve represents an attempt to neutralize the alien by depression of the fire switch 32, in which event the slope of the curve portion D is steep indicating a rapid loss of energy at a rate determined in accordance with the program in the microprocessor 50. For this particular game, this value is assigned as a 60 units per second rate of loss of energy.

E. At this point the neutralization attempt has been successful and the fire button 32 is released.

F. The graph portion depicted by the reference letter F illustrates the rapid increase in energy level taken from the alien after a successful neutralization attempt. In the instant game, the value of the increase in the energy level is the product of some preassigned number of units multiplied by the value assigned by the microprocessor 50 to the strength of the alien, and may be for example fifty units of energy times the value assigned to the strength of the alien.

G. At the commencement of the curve portion designated G the second of the aliens in the vicinity is initiated by the microprocessor 50, and the energy build up commences at a predetermined rate.

H. As the curve portion G reaches its peak, the search buttons 34, 36 are depressed to search for a new alien with the rate of decrease of the energy value remaining being depicted by the slope of the curve H.

I. During this portion of the curve designated I, the operator being unable to audibly ascertain any viable signals, and while noting the decrease in energy, determines to increase the energy level at the expense of the loss of time, and at the expense of being captured by the alien. The initiation of the curve portion designated I indicates the release of the search buttons 34, 36 for the time duration of the "recharge".

J. At the initiation of the portion of the curve designated J, the operator again depresses the search buttons 34, 36 with the energy decreasing as determined by the slope of the curve. It is to be noted that the slope portions designated C, H and J have the same slope, these three instances being the same function, that is the "search" function.

K. At the commencement of this portion of the curve, the "fire" button 32 is depressed to attempt to neutralize the alien with the time duration of depression being determined by the strength of the alien as determined by the audible signals emanating from the speaker 40 of the game 20. By comparison of this portion of the curve with the portion designated D, it is to be noted that the length of that portion of the curve designated K is longer than that portion of the curve designated D. This may result from the operator's assessment that the second alien is stronger than the first, or from error on the part of the operator.

L. At point L the fire button 32 is released.

M. After the cessation of the fire attempt, the energy level increases immediately as indicated by the portion of the curve designated M, this increase being comparable to the curve portion designated F. By comparison of heights of the two curves, it can be seen that the length of the curve portion designated M is much greater than that designated F indicating that the operator's assessment that the level of strength of the second alien was much greater than that of the first was correct.

N. During this portion of the curve, a third alien is generated by the microprocessor 50 and the energy begins building before searching for the third alien.

O. During this portion of the cycle, the search buttons 34, 36 are again depressed to search for the third alien with the energy level decreasing at a predetermined rate, this slope being identical to the slopes of the curve portions designated C and H.

P. This portion of the curve designates another fire attempt.

Q. During this portion of the curve, the player or operator has missed the alien resulting in an unsuccessful attempt. At this point, the player decides to recharge thus increasing his energy level as shown by the upward ascent of that portion of the curve designated Q. During this time span, the third alien gets closer, with the nearness of the alien being determined by the amount of time expended by the operator in accordance with the program in the microprocessor 50.

R. The player then depresses the search buttons 34, 36 again to renew the search for the third alien.

S. In accordance with the rules of the game, the operator has the option, when he believed he has expended too much time in searching for an alien, or that the alien is too close and is ready to capture him. With this option, the operator can depress the repel button 30 resulting in a loss of energy of a magnitude determined by the microprocessor 50. Depression of this button 30 results in instantaneous energy loss of some predetermined magnitude such as 100 units and simultaneously nullifies the alien then being hunted.

T. During this portion of the curve no buttons are depressed and the microprocessor 50 provides for a recharge of the energy level displayed on the display 42.

U. This portion of the curve signifies the capture of the operator by the alien resulting in an instant energy drain to zero.

V. At this point, the energy level has declined to zero signifying the end of the game and further signifying that the player loses.

The graphical illustration of energy level depicted in FIG. 5 represents the typical game play assuming all four aliens have been generated by the microprocessor 50. It is to be understood however that in the event any of the aliens captures the detector, the game play will be ended by an instantaneous absorption of all energy from the detector 20 by the alien.

To summarize the game play and game functions, certain values are preassigned for scoring purposes. These preassignments are in designated portions of the memory of the microprocessor 50 and may include rate values, initial energy values, alien strength values and scoring multiple values.

For example, an initial energy value of 200 energy units is assigned at the start of the game. An initial number is stored for the number of aliens to be generated during play of the game, and in the instant game, this number is four representing four aliens. Each alien in turn is assigned a "strength level" from 1 to 4, with some random generation of a number between these values being determined by the program within the microprocessor 50.

An "energy add" rate of three units per second is assigned for the building up of energy prior to commencement of search as depicted by the portions of the curve B and G of FIG. 5 for example.

Other "rate" numbers are likewise stored such as the value of four units per second during the search effort as well as a sixty units per second rate for loss of energy during a "fire" attempt.

The microprocessor likewise includes score determining means, in this case a multiplying of fifth units times the random strength of the alien between the numerals 1 and 4, the product being the value added to the displayed energy after a successful attempt by the operator as depicted by the curve portions F and M.

Within the program of the microprocessor 50, there are also other random values generated for the location and distance of the alien then generated, these values altering the audible signal emitted from the speaker 40 in accordance with the algorithm therein.

In addition, a value of 100 units is stored for subtraction from the value on the display 42 when the "repel" button is depressed.

As previously discussed, the microprocessor 50 is a National Semiconductor microcontroller of the family referred by the designation COP410L and includes a 512 word by eight bit read only memory with a thirty-two word by four bit random access memory. In such devices the "program" is stored in the read only memory with the program designated data transfers required for operation of the particular program. For this purpose, certain portions of the random access memory, that is individual registers, may be designated for particular functions during certain data transfers. For this purpose, the programmer will create what is known as a "RAM map" with certain registers being preassigned to receive certain data, or certain intermediate computations during execution of the program. Upon initialization, certain designated registers will be loaded with certain data at the commencement of the program operation, with this data then being utilized or updated as the game progresses.

Typically, with microprocessor based devices, the program will include a number of subroutines which are repetitively performed, hundreds or even thousands of times a second, to constantly sample inputs, as well as constantly and periodically provide outputs to the designated output devices such as the display 42 and audio speaker 40 of the instant game. Some of the more standard subroutines employed are "keyboard test" subroutines (to determine the status of the various input switches), the "display" subroutine (to periodically update the display 42 at a "flicker-free" rate), and a "sound" subroutine to generate the sound required at a particular time).

Figure 6:
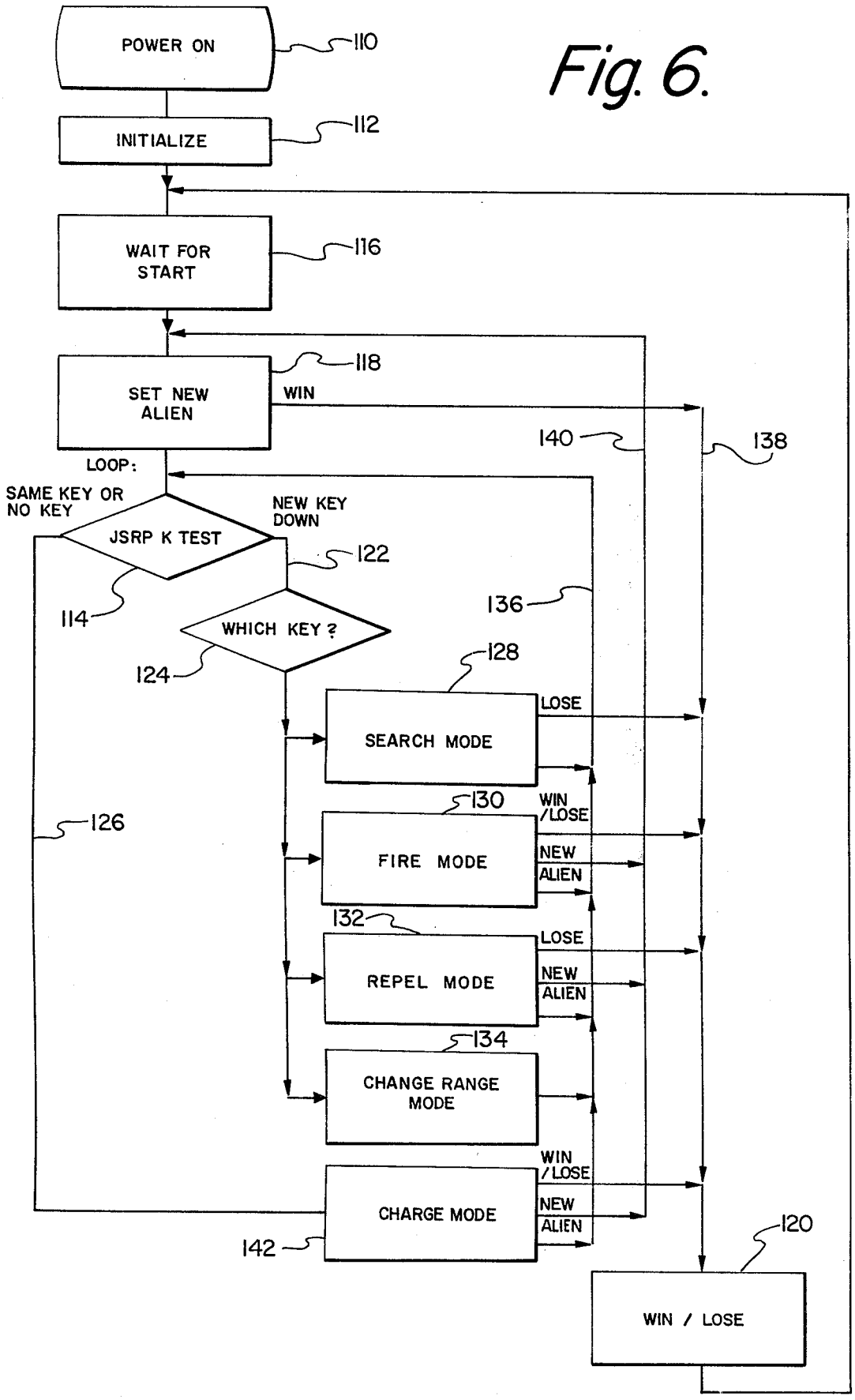
FIG. 6 is a functional top level low diagram depicting the main functions of the microprocessor of the game of FIG. 1.

By reference to FIG. 6, there is shown a system flow chart depicting the top level of the program incorporated within the microprocessor 50. The flow chart includes ovals such as oval 110 designating a terminal point in a program, uses rectangles such as rectangle 112 to indicate a processing function and uses a diamond symbol such as diamond 114 for depicting decision ponts or test points which alter the flow of the program from that point on depending upon the results of that test.

When the power to the game 20 is turned on as depicted by the oval 110, the microprocessor 50 is then initialized such as shown by block 112 and then a "wait for start" processing is performed as depicted by block 116 and thence onward to the processing of block 118 to "set the alien" (or set the new alien as the case may be), with this processing then resulting in a test at block 114 to jump to the keyboard test subroutine. A second output is provided from block 118, this output being designated "win" to the "win/lose" processing function depicted by block 120, this output normally occurring after all aliens have been neutralized.

During the keyboard test routine in diamond block 114, one of two results exist. Either there is a "new key down" in which case the program flows over lead 122 to the next decision point depicted by diamond 124; or data flows over lead 126 as a result of the same key being depressed or no key being depressed. After the decision is made at block 124 as to which key is depressed, one of four processing modes is selected, these being the "search" mode as depicted by block 128, the "fire" mode as depicted by block 130, the "repel" mode as depicted by block 132, or the "change range" mode as depicted by block 134. In response to the processing occurring in the blocks 128, 130, 132 and 134, one of three outputs occur. In some instances there is an output loop over lead 136 to again perform the keyboard test function 114. With respect to the search mode processing 128, an output is possible over lead 138 to the "win/lose" processing at block 120 if the player loses during the search mode, that is, the alien captures the detector or game 20.

If the player depresses the "fire" switch 32, depending upon the result, the program flow is threefold, one to the "win/lose" processing function 120, one generating a "new alien" over the data path 140 which then sets a new alien, provided an additional alien is still available, or back to key test if a "miss" occurs.

If the player depresses the "repel" switch, a "lose" signal is indicated to the "win/lose" function 120 if less than 100 units were available or a new alien is generated over data path 140.

If the keyboard test function 114 indicates the same key or no key, the data flow over data path 126 goes to the "charge" mode processing function depicted by block 142, the outputs of which provides a "win/lose" or "new alien" or key test data flow depending upon circumstances.

For the program subroutines of the instant invention, there are certain subroutines which are "primary" subroutines, that is, subroutines which are specific to the game play with other program subroutines being designated secondary, such secondary subroutines being of a general type applicable generally to microprocessor systems having inputs and outputs. For example, such secondary subroutines would include a keyboard test subroutine to determine which key has been depressed along with a display subroutine and the initialize subroutine. Such subroutines will be described without reference to flow charts or drawings.

During initialization, as in any microprocessor system, depending upon the architecture and the rules of the game, registers and the accumulator will normally be initially cleared with certain random access memory registers being initially loaded with certain constants. In this particular instance, upon initialization the accumulator is cleared, a seed number is placed in a RAM Register (to be used subsequently for random number generation), and the RAM Registers for display purposes are initially set to zero (to enable the display to read zero rather than have a random display when the power is turned on). In addition, certain RAM Register locations are loaded with "flags" such as a keyboard flag (to indicate to the program that the keyboard may be subsequently tested). During initialization other RAM Registers may likewise be loaded with certain values indicative of time delays utilized during execution of the program with these time delays then being subsequently recalled as required.

Figure 7:
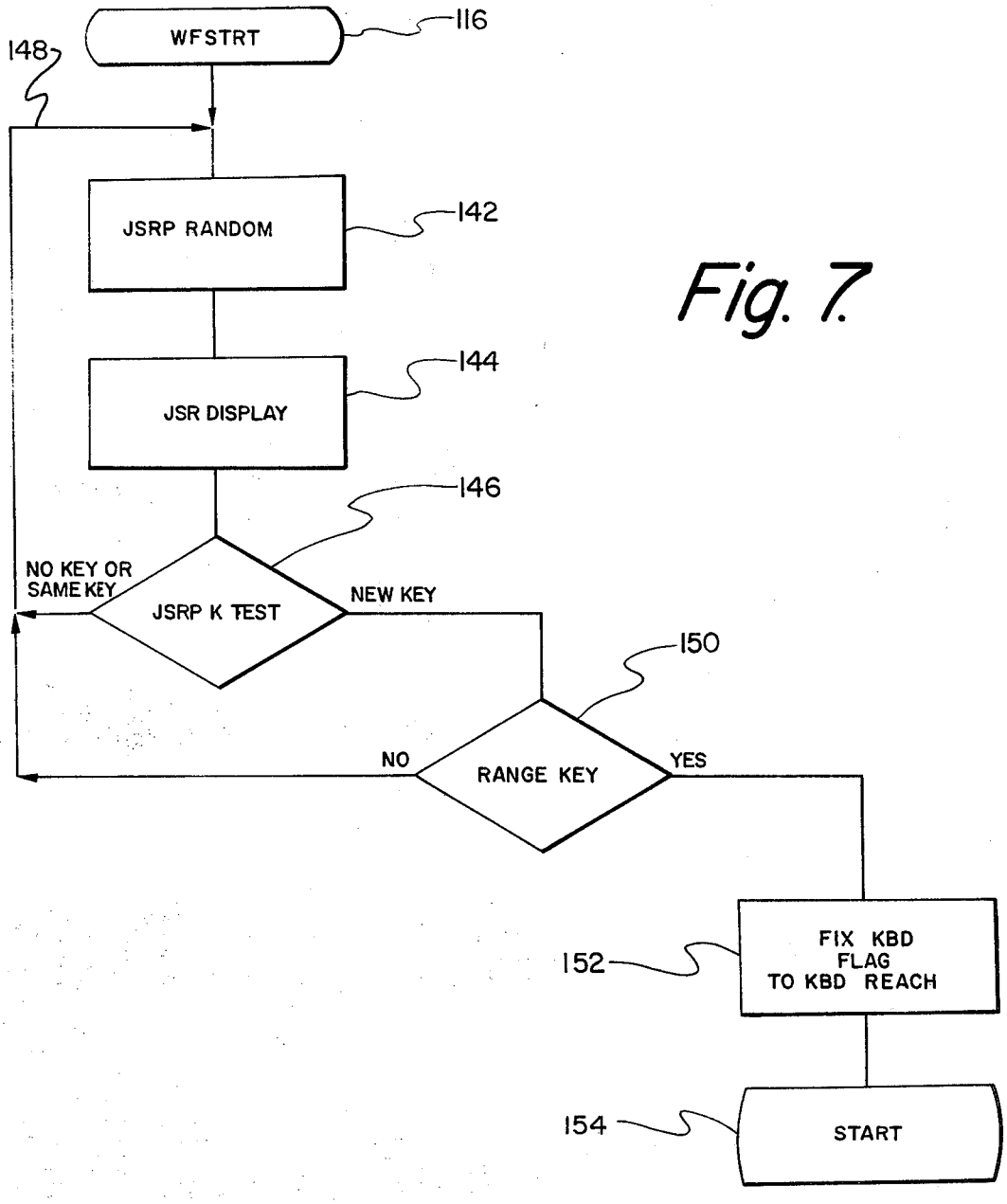
FIGS. 7–13 are functional flow diagrams of routines and subroutines performed in conjunction with the flow diagrams of FIG. 6.

After the initialization processing as depicted in block 112 of FIG. 6, the "wait for start" processing in block 116 is then performed. The "wait for start" is shown in FIG. 7 with the designations WFSTRT, the flow diagram proceeding to the first processing block 143 which depicts a jumping to the random subroutine (for generating a random number utilizing the "seed" number previously referred to) and thence to the next processing block 144 indicating a jump to the display subroutine for the purpose of refreshing the display. The program then proceeds to the decision point depicted in block 146 which is the keyboard test subroutine. If no key has been depressed the program loop data path follows path 148 to iterate the processing functions performed in blocks 142 and 144. If a key has been depressed, the program then commences to the next decision which is the "range key" decision (the depression of a range key 24, 26 or 28 being required to initiate play of the game). If no range key has been actuated the program loops back over lead 148 for another iteration. If a test performed at the decision block 150 indicates a range key has been depressed the program then commences to block 152 to fix the keyboard flag (previously referred to) to a keyboard ready position to thus initiate the "start" operation 154.

The random subroutine will not be described in detail and is well known to those skilled in the art. For example, in the instant game a four bit random code is generated with two, three or four bits being selected from that code as determined by the program to generate a random number at that point in time. The random number so generated is then utilized in subsequent processing for the random number requirements of the particular program. For example, as previously described, random numbers are utilized in the instant game for establishing a light level from which incident light is measured; a random number is utilized for the "alien strength" with this random number being between one and four; random numbers are utilized to establish a distance and location of the alien for subsequently altering the tone or sound emitted from the speaker 40; and random numbers are utilized to establish certain time limits during which each alien must be captured or neutralized.

Similarly, a display subroutine is well known to those skilled in the art and requires that the display subroutine be executed a sufficient number of times per second in order to refresh the display at a "flicker-free" rate. The display subroutine will periodically access a particular register of the random access memory containing information on the value of the then remaining energy during play of the game. The value in this register will be constantly updated by incrementing or decrementing depending upon event occurring during play of the game as previously described in conjunction with FIG. 5.

Referring again to FIG. 7, after the display subroutine processing, the "keyboard test" is performed to determine if a key has been depressed. With microprocessors such as the microprocessor 50 employed in the instant application, the various input/output leads are scanned, and turned off and/or on in sequence for enabling inputs and outputs to the internal microprocessor architecture as required. The inputs and outputs are normally through the accumulator, but in accordance with certain computer architecture such information may be gated to other registers for holding purposes prior to subsequent operation. In FIG. 3 the inputs/outputs are designated by reference letters L (followed by numerical designation), D (followed by numerical designation), G (followed by numerical designation), IN (followed by numerical designation), and SI. Within the microprocessor 50 there is contained, in addition to an accumulator, a B register, a D register, a G register, a serial input/output register, and a Q register associated with the line (L) drivers. The designations within the microprocessor block 50 are designated with respect to the registers or drivers with which each of the input or output lines is associated. These designations in the internal architecture of the COP410L are described in more detail in the aforementioned publication of National Semiconductor Corp.

As part of the keyboard test subroutine the input keys or switches are periodically sampled. In addition, during this subroutine, the output leads are enabled (that is turned on and off) for a predetermined time duration. If key activity is detected, the microprocessor must then determine which key has been actuated in order to determine flow of program from that point on. As previously discussed, the game is initiated by the depression of one of the range keys 24, 26 or 28, after which subsequent actuation will be detected, this condition being depicted in FIG. 7. Another normal part of a keyboard test subroutine is a "debounce" function. This debounce function is to eliminate transient surges during initial depression of a key and normally requires that the actual test be made some time duration after the transients have subsided. The keyboard debounce is a conventional program subroutine function and need not be described in detail.

Figure 8:
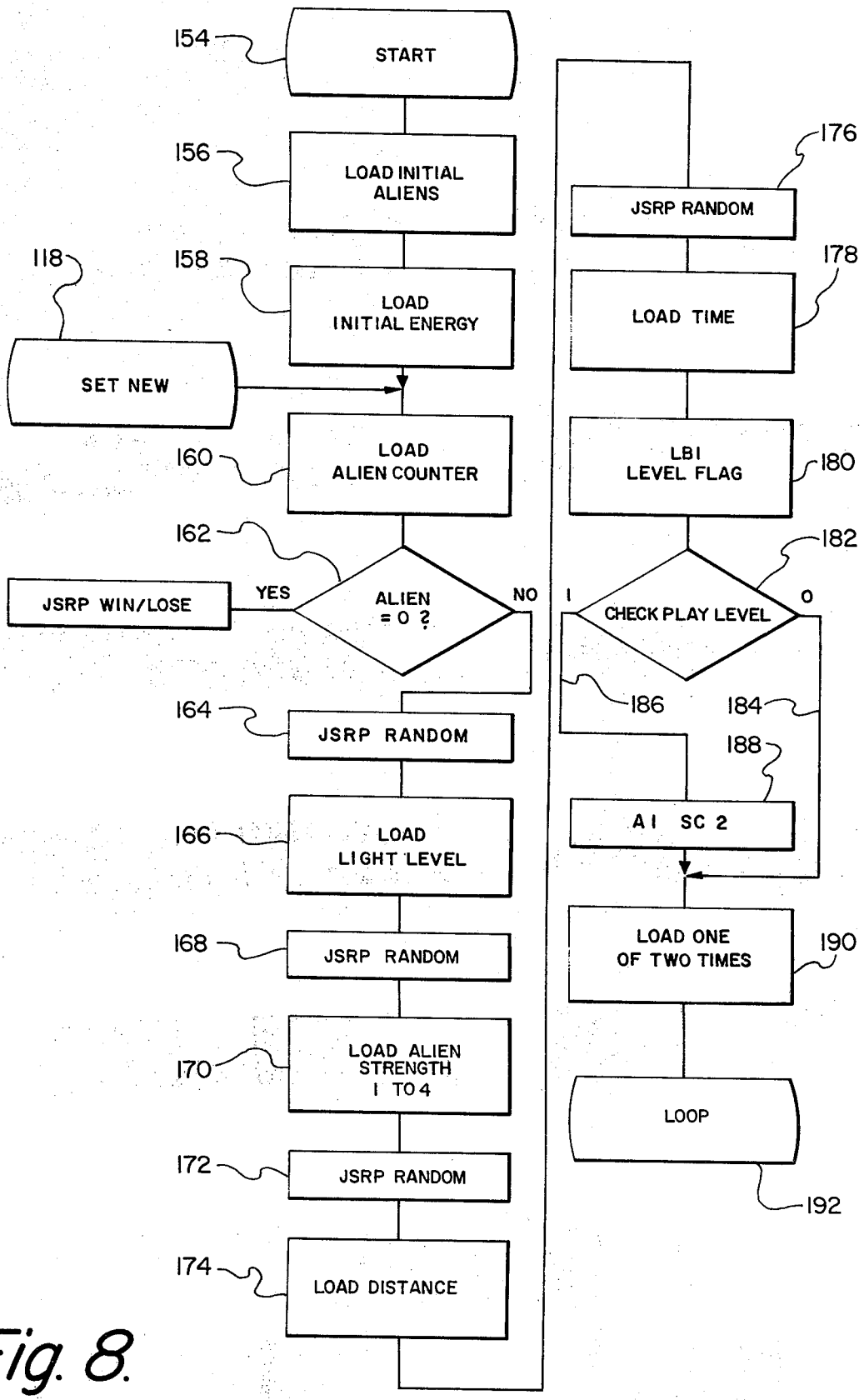

Referring now to FIG. 8 there is shown a functional flow diagram of the "set new alien" subroutine commencing with "start" as depicted in oval 154. The first step thereafter in the flow diagram, as depicted in block 156, is to load the initial number of aliens, that is to place into a counter or register an initial number equal to the number of aliens provided in the game, in this game the number would be four. The program then sequences to the next step depicted in block 158 which is to load into an appropriate register the initial energy level. The next step in the sequence is to load the alien counter, as depicted by block 160 with the appropriate number from which the count is decremented as the "set new" function depicted in oval 118 is initiated, with each initiation decrementing the alien counter. The program then proceeds to the decision as to whether or not the alien count is equal to zero (the number zero indicating no more aliens). This is depicted in decision block 162. If the last alien has been exhausted the program jumps to the "win/lose subroutine" and if the alien count is greater than zero the program proceeds to the next function depicted in block 164, this being a jump to the random subroutine. In the next function block 166 the random number thus generated is modified to a numerical value consistent with the program and then loaded into a RAM register as a light level value. This light level value can be represented in the instant game by a digital value for the numbers 8 through 15. In the next step in the program at block 168, the program again jumps to the random subroutine and at function block 170, the number so generated is appropriately modified and loaded as an "alien strength" in a predefined register location of the random access memory. It is to be understood that although the function blocks 166 and 170 merely refer to loading, the processing incorporated in these particular blocks also includes processing of the random number to provide the integer value for the appropriate register. The alien strength register will then be loaded with a randomly selected number from one to four, this number subsequently being utilized for scoring purposes as well as for purposes of display generated in accordance with the strength.

The program then proceeds to block 172, again to the random subroutine, for generating another random number which is then processed at block 174 and loaded as a range or distance value, this value likewise being stored in a predefined random access memory register location. The program then again jumps to the random subroutine at block 176 to provide a random number indicative of a time value which is loaded into an appropriate register at block 178. In the next processing step at block 180, the block is designated LBI level flag, this level flag being loaded during the initialize subroutine to establish a play level of complexity for the particular play of the game with the LBI being a mnemonic designation for the particular processor to load the B register to point at the memory register containing the "flag" information. The contents of the register are then tested at block 182, this test consisting of checking one bit of the four bits of the flag code. If the bit is "0" the program proceeds along data path 184, and likewise if the second bit is "1" the flow proceeds over lead 186 to the processing function block 188 which is designated AISC2 (a mnemonic to add 2 to the time, allowing longer play for the lower level game play).

From block 176 through block 190 of the flow diagram of FIG. 8, the following events occur. The random number generated at block 176 is suitably processed and loaded at block 178 as an integer value from 10 through 13. The processing function depicted in block 188, assuming a "1" play level modifies this time value to an integer value of 12 through 15. With this processing, the time duration of play for a particular alien is represented by an integer value within one of two ranges determined by the play level. The number so selected is then loaded as one of two time values at block 190 with a subsequent return to LOOP at 192, this LOOP designation being illustrated in FIG. 6 just prior to the keyboard test at block 114.

As each alien is dispensed with by a win or lose the set new alien block 118 restarts the program by reloading the alien counter at 160 whereupon the different variables are then again recalculated in accordance with the flow diagram of FIG. 8. This proceeds until there is an early loss because of premature exhaustion of energy or until the alien count decrements to zero.

Other primary subroutines include the SEARCH subroutine, the LITE subroutine, the FIRE subroutine, the REPEL subroutine, the CHANGE RANGE subroutine, and the CHARGE subroutine. Secondary subroutines utilized during the play of the game include sound generation, the win/lose and some elapsed time subroutines which are utilized to decrement the time count of play during the game. Another secondary subroutine relates to the incrementing or decrementing of the count related to energy in accordance with the increment or decrement rate for the mode selected over the time duration of that mode.

Figure 9:
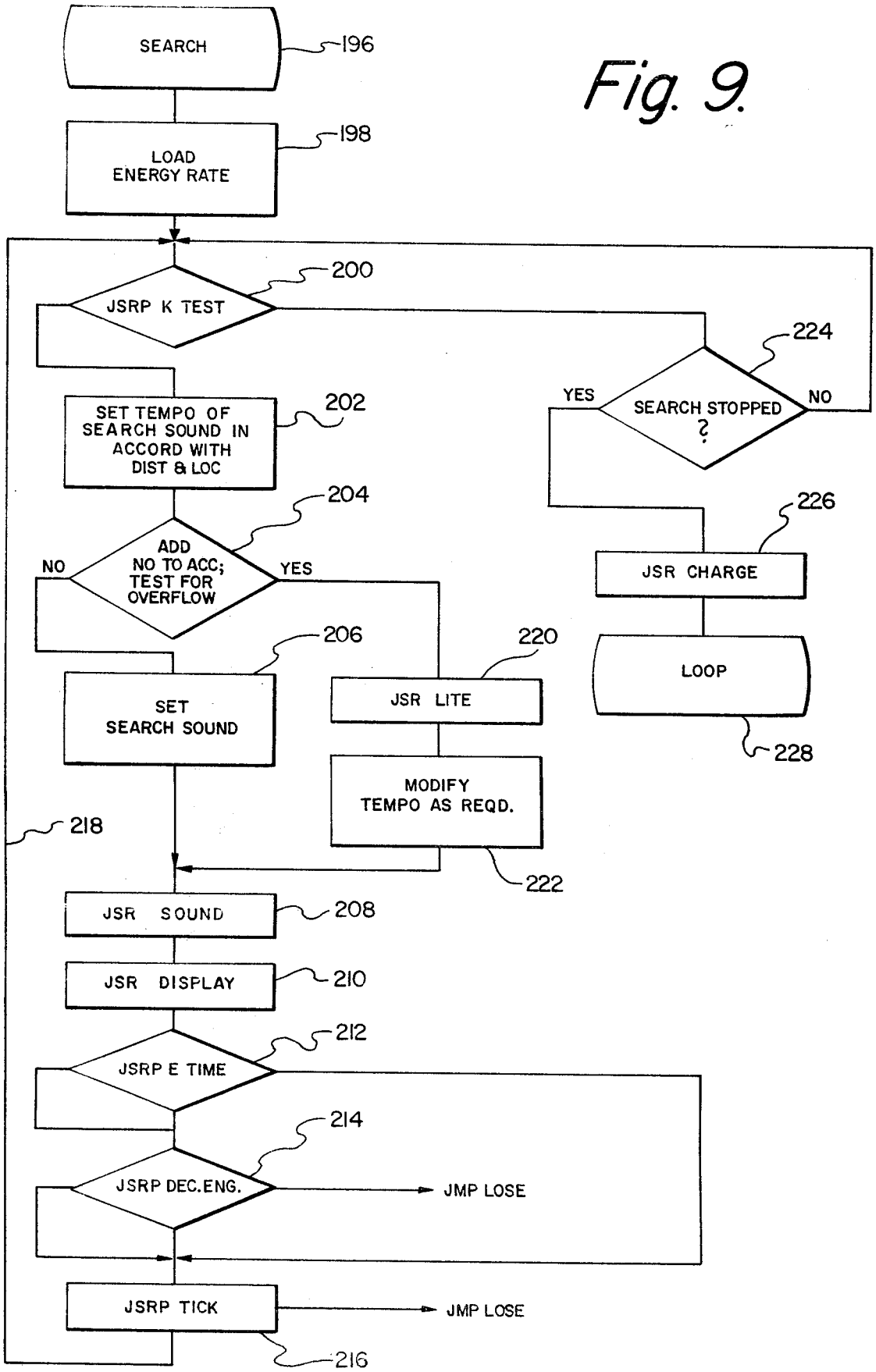

Referring now to FIG. 9, the "search" subroutine will now be discussed. During the search subroutine, as previously discussed there is a rate of energy consumption during the search phase from the initial value, this energy rate decrementing at a rate of four units per second. During this portion of the program, the keyboard is tested, the memory is addressed to a particular song or sound applicable to the search phase with a "tempo" being assigned to that sound to generate audible clues indicative of the location and distance of the alien. Likewise, during this program execution, the display must be updated, the elapsed time must be monitored and the energy decremented as required. The search loop initiates block 196 whereupon a register is loaded with the applicable energy rate at 198 and the keyboard is tested at 200 to determine subsequent actuation of other keys. If the search key is still depressed, the program branches to the function in block 202 which is to set the tempo of the search song or sound in accordance with the distance and location of the alien. From thence the program proceeds to a decision function 204, which is to add a predetermined number to the accumulator and test for overflow. Initially the accumulator will not overflow and the lefthand branch of the program will be followed to set the search song or sound as designated at block 206. Although not described, within the program there will be a number of different songs or sounds, each being applicable to a given situation or event, with the sound for a particular event being selected by the subroutine for that event.

Once the search song or sound has been selected, the program then proceeds to the sound routine as indicated by block 208, after which the display is updated by the display subroutine as indicated in block 210. Subsequently the program jumps to the elapsed time subroutine as indicated at block 212 and thence to the "decrement energy" subroutine as indicated at block 214. In the event the elapsed time determined by the decision block 212 is equal to zero, the program skips the decrement energy subroutine since the game will be over. Likewise, if upon decrementing of the energy in the decrement energy subroutine, the energy level remaining equals zero, the program then jumps to the "lose" portion of the win/lose subroutine. After the appropriate subroutines have been executed, the program then flows to the next block 216 which causes the "tick" subroutine to be executed, this subroutine effectively addressing a counter which does the actual counting down for the elapsed time at a predetermined rate in accordance with the computer program. If the count equals zero, as previously discussed, the program branches to the "lose" portion of the win/lose subroutine. Alternatively, if a count still remains the program loops back over data path 218 to again perform the execution of the subroutine as required, commencing with the keyboard test as indicated at block 200.

On a subsequent iteration through the subroutine, at block 204, if the accumulator has overflowed the alternate branch to the right thereof will be executed, the first function being a jump to the LITE subroutine as shown in block 220 with a modification of the tempo of the search sound in accordance with the results of that subroutine test as shown in function block 222. As will be described hereinafter during the execution of the LITE subroutine the reference signal generated by the microprocessor will be compared with the incident light impacting on the phototransducer 44 as previously described with the result being one of three possible results, that the light level has remained unchanged, that the incident light level is brighter than the reference light level, or the incident light level is dimmer than the reference light level, with these latter two events requiring a change in the audible signal generated by the sound subroutine to provide the operator with an audible clue of this change.

During the keyboard test decision at block 200, an alternate branch program is executed if the search has been stopped by release of the search button as depicted at block 224. If the search has been stopped, the program then branches to the charge subroutine as depicted at block 226 to recharge the energy as determined in accordance with the subroutine and then back to the primary loop point as depicted in FIG. 6 prior to the keyboard test at 114.

Figure 10:
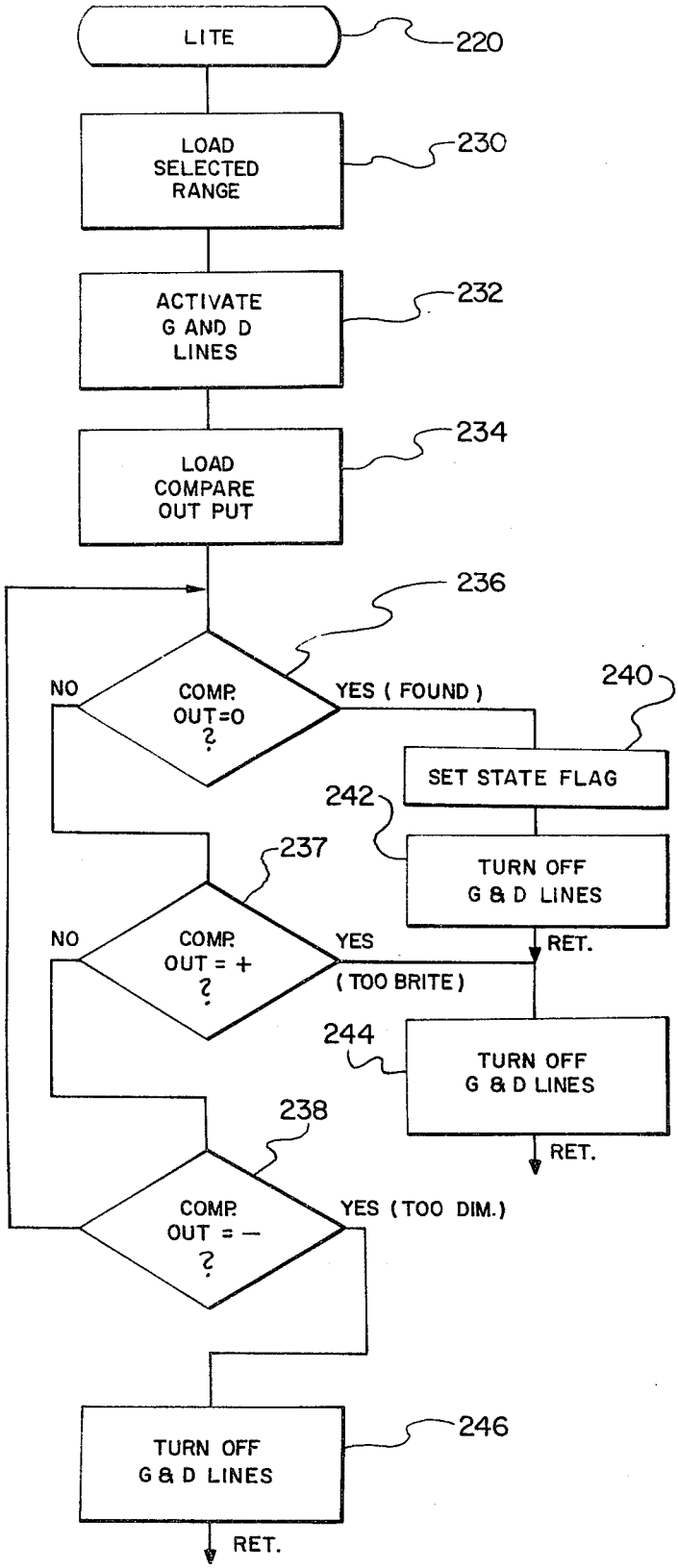

FIG. 10 illustrates in flow diagram form the LITE subroutine function of block 220 of FIG. 9. In this subroutine the light is tested by comparing the selected light range predetermined by the microprocessor 50 with the incident light impacting on the phototransducer 44. In accordance with this subroutine, the selected range, that is the light intensity level automatically determined by the computer program is loaded as depicted by function block 230 whereupon the G and D lines of the microprocessor 50 are activated as depicted in function block 232. By reference to FIG. 3, the G and D lines 71–78, in accordance with the digital value of the selected range 230, are activated or not activated as the case may be to provide a first analog input value to the comparator 56 which provides an analog input. At this moment of time, the incident light impacting on the phototransducer 44 provides a second analog value on input lead 68 to the comparator 56, the output on lead 80 being either positive going, negative going or zero. In any event, the next function 234 of the program loads this comparator output as one of three states, the input/output ports of the COP 410L family being tri-state inputs/outputs. The succeeding three decision blocks 236–238 examine the comparator output to determine if it is zero (indicating that the two inputs to the comparator 56 are equal), positive going (indicating that the voltage from the phototransducer 44 is greater than the reference voltage appearing on lead 70, meaning that the incident light is brighter than the reference light), or negative going (indicating that the incident light is dimmer than the reference light). If the first event occurs, that is the zero state, the program branches to set a state flag as depicted at block 240, indicating the occurrence of the event, after which the G and D lines are deactivated or turned off, at block 242, with a return being executed to return to the program subroutine causing the jump to this subroutine. Correspondingly, if the second or third events occur, that is the incident light it too bright or too dim, in either event, the G and D lines are turned off (blocks 244 and 246 respectively), and a return is executed to the primary subroutine.

Figure 11:
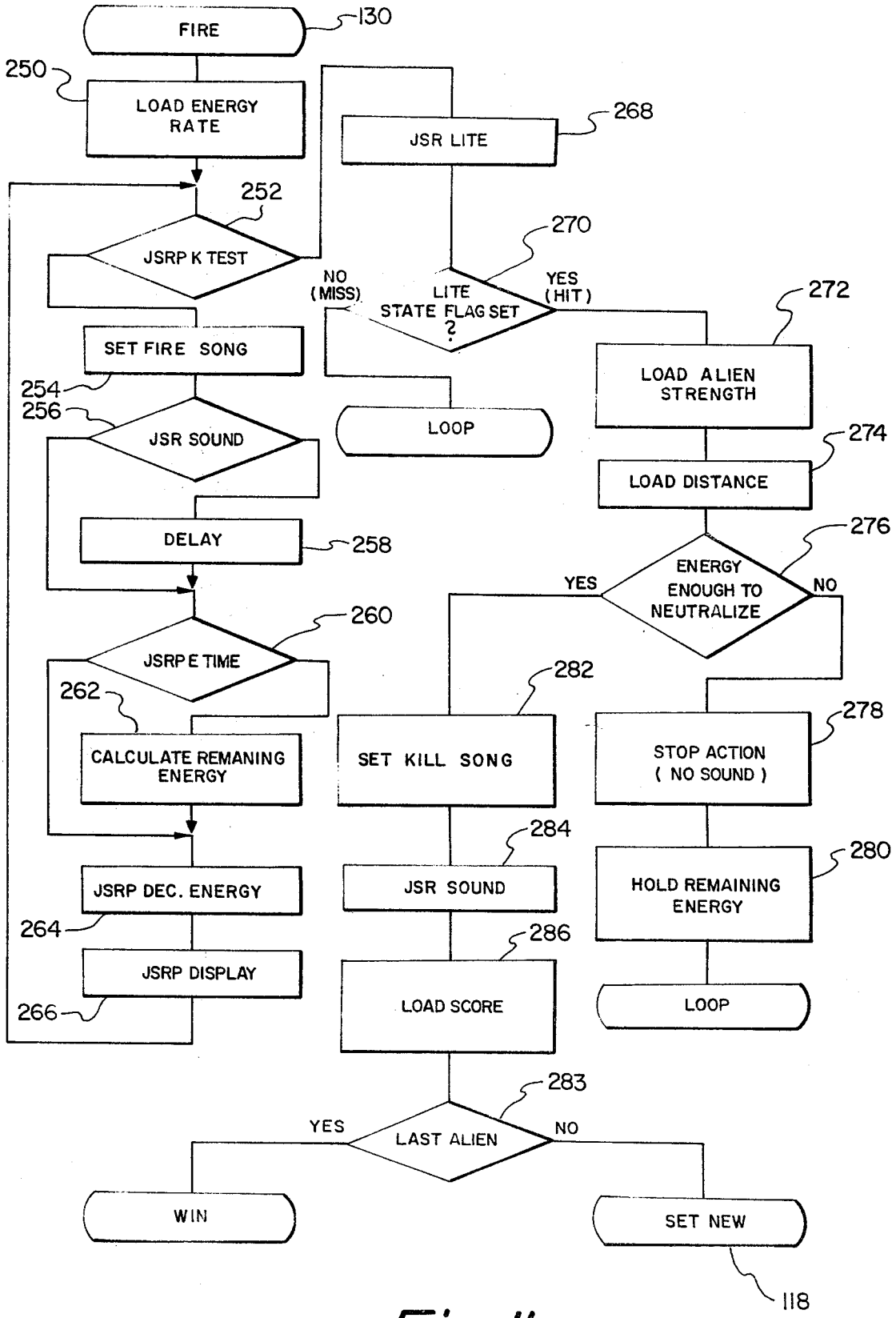

Referring now to FIG. 11, the flow diagram for the FIRE subroutine will be described, the FIRE terminal being designated 130, after which the energy rate of sixty units per second decrementing of the energy is loaded as indicated at block 250. The subroutine then proceeds to a keyboard test at 252 after which one of two alternate branches is executed. Proceeding with the left branch of the flow diagram, the program then sets the fire song as indicated at 254 after which there is a jump to the sound subroutine at 256. After the sound subroutine is executed, the program branches through either a delay 258 or directly to the elapsed time subroutine as depicted at block 260. Depending upon whether or not time remains, the program then branches either to the next subroutine or through the intermediate step of calculating the remaining energy at 262. Thereafter, the program jumps to the decrement energy subroutine 264, then jumps to the display subroutine at 266 and returns for another iteration. On alternate iterations, after the keyboard test at 252, the program then branches to the LITE subroutine as depicted at block 268 after which the light level state flag is tested at 270. If the state flag has not been set, this constitutes a "miss" and the program then branches back to "loop" of the primary program depicted in FIG. 6.

Alternatively, if the state flag has been set this indicates a "hit" which results in one of two events. If the operator has expended sufficient energy to neutralize the alien, a "kill" is effected. Alternatively, if the operator has not expended sufficient energy, the action stops for some predetermined time duration after which the alien runs away and is not replaced, the play then commencing to the next alien.

On a "hit", in sequence the alien strength is loaded at 272 and the distance is loaded at 274, these being the variables required for calculation. In the next block 276 if the energy expended was not enough to neutralize the alien, the program then executes a stop action which curtails the sound as depicted at block 278, then proceeds to block 280 to hold the remaining energy level, there being no scoring for expending insufficient energy, after which the program returns to loop in the basic program.

If enough energy has been expended as determined by block 276, the program branches to set the kill song at 282, then jumps to the sound subroutine at 284 and then loads the score (block 286) determined in accordance with the strength of the alien. Afterwards, the alien counter is tested at 283 to determine if the iteration was with respect to the last alien. If the last alien had been neutralized, the program then branches to the "win" subroutine. If not, the program then branches to the "set new" point.

If, during play, the operator determines to change the range by depression of another range select key 24, 26 or 28, this activity is detected by a "change range" subroutine which updates the selected range from a new range key input. During this subroutine, the previous range is loaded, the value is complemented, and a scramble function is performed as a randomizing process to establish a new selected range within the limits prescribed by the program. The sound subroutine is accessed to generate a note indicative of the key actuation and after a subsequent keyboard test the subroutine returns to the "loop" entry point of the basic program.

Figure 12:
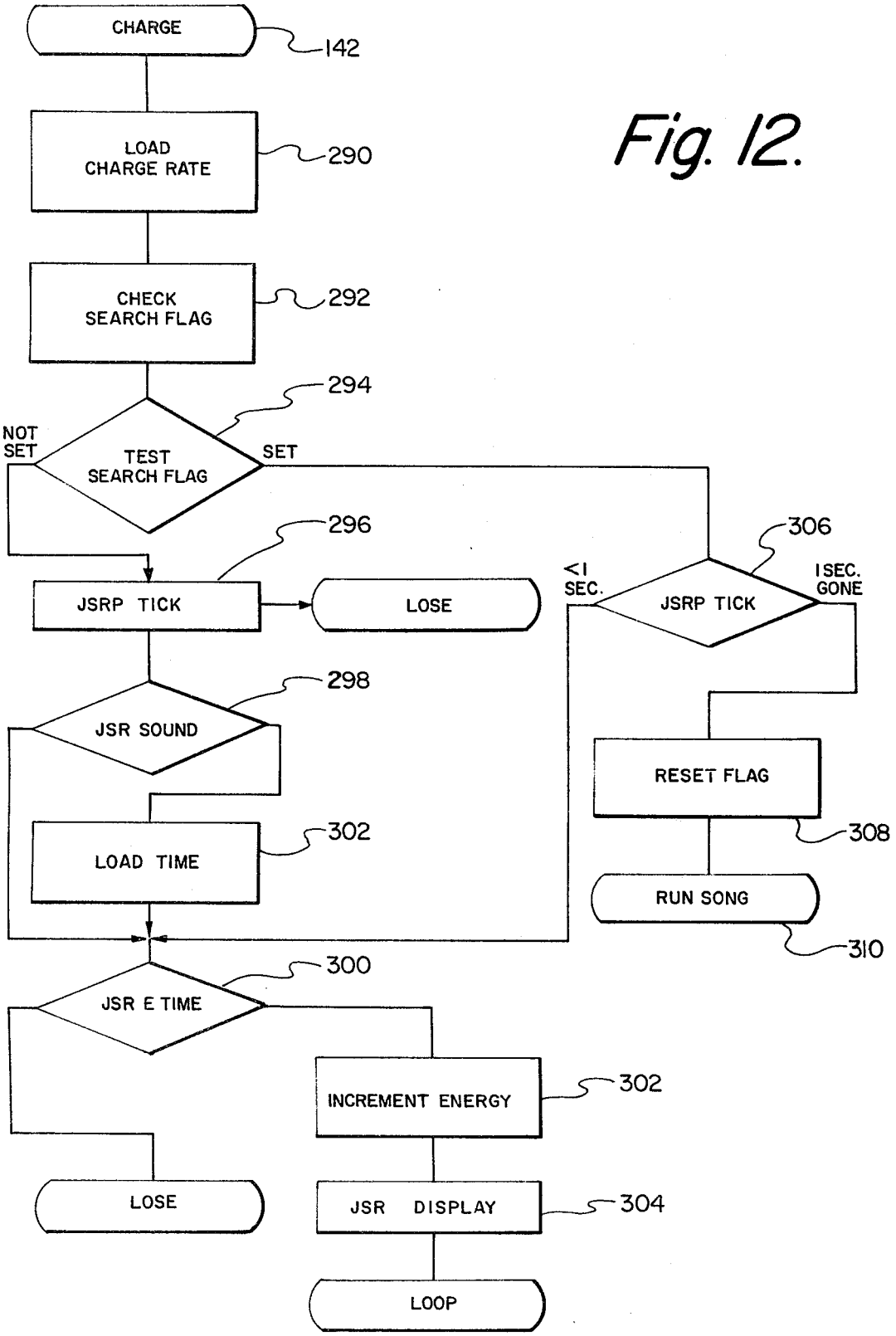

The charge mode occurs on one of two conditions. Upon initiation of the game and after a range select switch 24, 26 or 28 has been depressed, or charge occurs after the search switches 34, 36 have been depressed followed by a releasing of the switches. This is set out in flow diagram form in FIG. 12. When the program enters the charge loop at 142, the charge rate is loaded at block 290, the charge rate being set for incrementing energy at the rate of three units per second so long as the charge program is being executed. In the next block 292, the "search" flag is checked, this flag being checked to determmine if a charge event occurs after release of a search button. In the next step, the search flag is tested at 294, and if the flag is not set indicating that the operator has not entered the search mode, the program branches to the tick subroutine at 296 to check the time. If the time has elapsed the program branches to the lose loop of the win/lose subroutine. If time has not elapsed, the program then goes to the sound subroutine at 298 where it can follow one of two branches. Either directly to the elapsed time subroutine test at 300, or to the same point through an intermediate processing function at 301 which loads the time for the elapsed time test. If time has elapsed, the program branches to the lose subroutine, and if not, the program then branches to increment the energy at 302 and then jumps to the display subroutine at 304 before returning to the loop.

If, after a test of the search flag at 294, the search function is detected to have been initiated and then stopped, the program branches to the tick subroutine at 306. If less than one second has elapsed, the program branches to the elapsed time subroutine at 300. If more than one second has elapsed, the search flag is reset at 308 and the program loops to the "run song" 310 which is a part of the "repel" subroutine. This one second limiting factor is a preset game function that causes the alien to run away if the operator attempts to recharge for more than one second upon a certain condition. For this condition, a light emitting diode may be incorporated on the play panel to provide the operator with a visual indication of the existence of the condition.

Figure 13:
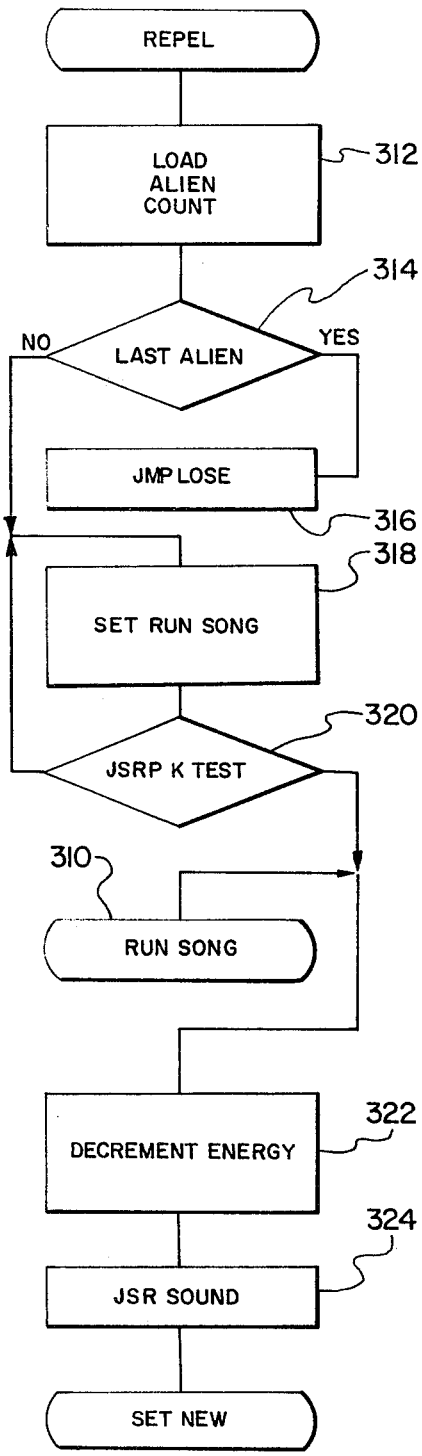

The REPEL subroutine is depicted in FIG. 13, with the repel subroutine first loading the alien count at block 312 and then testing the alien count number at 314. If the repel mode is entered on the last alien, the program branches to the lose subroutine at 316. If not, the program then sets the run song at 318 and then jumps to the keyboard test subroutine at 320. The program then proceeds to decrement the energy count at 322 (a loss of 100 units of energy in this mode) and then jumps to the sound subroutine at 324 prior to returning to the "set new" loop point. The runaway song may be entered at loop 310 from the charge mode previously described in conjunction with FIG. 12.

Execution of the various primary subroutines are interlaced with the more conventional subroutines for testing the keyboard for example as well as for providing outputs on the appropriate output leads for the display and sound. For example, by reference to FIG. 3, when the LITE subroutine is being executed, the leads designated G and D, that is leads 71–78 will simultaneously be energized to select the appropriate resistors R1 of the resistance bridge 54 for providing the reference light signal to input 70 of the differential comparator 56. During another given instance of time, only leads 75 through 78, that is the D output leads will be actuated by the program within the microprocessor 50 to provide appropriate digit location selection of one of the digit locations 86–89 with the so-selected digit location receiving its segment information simultaneously over output leads 90–96. During another instant of time, the output leads 82 and 84 will be selectively and sequentially energized in accordance with the appropriate song selected for the appropriate sound routine to thereby provide an audible signal at speaker 40.

In accordance with the instant invention, as previously described, the program within the microprocessor 50 randomly selects a digital value indicative of a reference light intensity with this value being output over leads 71 through 78 for presetting a resistance bridge network 54 to provide a first analog value input over lead 70 to differential comparator 56. As the player scans the environment, differing amounts of light intensity from the environment will impinge upon the phototransducer 44 for providing an actual light intensity signal over lead 68 of an analog value proportional thereto, this value being compared with the reference value to provide an output from the differential comparator 56 over lead 80 to the microprocessor 50. Depending upon the reference value selected by the program within the microprocessor 50 and the actual light intensity on the phototransducer 44, the microprocessor generates sounds through lead 40 to provide the operator with audible signals of the alien location. With these clues or audible signals, the operator has the power of selection of one of several modes, with this selection altering the energy value on the display 42 in accordance with that selection.

Figure 14:
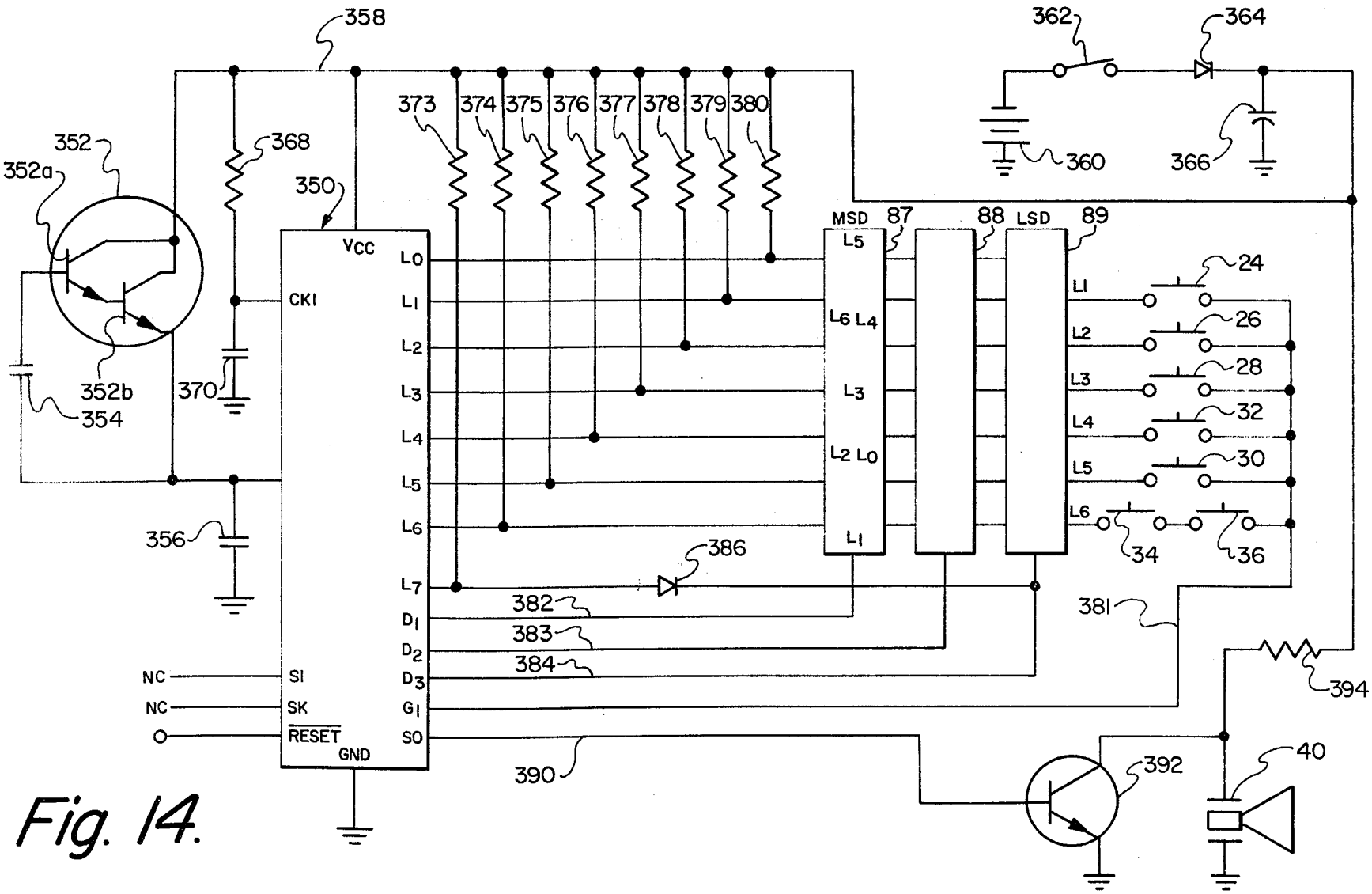
FIG. 14 is a partially schematic, partially block diagram of an alternate embodiment of the game of FIG. 1.

Referring now to FIG. 14, there is shown a partially schematic, partially block diagram of an alternate embodiment of the game of FIG. 1. By comparison of the diagram with that of FIG. 3, as will hereinafter be described, the alternate embodiment of FIG. 14 is simpler, and more economical by virtue of having fewer components, yet performs the majority of the functions hereinbefore described relative to the first embodiment diagramatically illustrated in FIG. 3. As can be seen by comparison of FIG. 3 with FIG. 14, the differential comparator 56 has been eliminated and the resistance network forming the digital-to-analog converter 54 has been eliminated. Furthermore, the number of digit locations has been reduced from four to three while the number of inputs to the microprocessor (corresponding to the switches of the game 20) have remained the same. In the embodiment of FIG. 14, a green light emitting diode has been added to provide simplification from the player standpoint, with this light emitting diode being illuminated for a short time duration indicative of the alien being aligned for the purpose of establishing a visible clue for alien presence to advise the player to initiate the "fire" sequence. With the somewhat simplified version of FIG. 14, a standard commercial microprocessor such as the COP411L may be utilized without expensive modifications of adding additional input/output leads.

In conjunction with FIG. 14, certain of the components thereof have the same reference numerals as the corresponding components of the embodiment depicted in FIG. 3. Where the components have been changed or reduced in number, other reference numerals are utilized. For example, the switch designations bear the same reference numerals 24, 26, 28, 30, 32, 34 and 36. Also the digit locations bear reference numerals 87–89 inclusive, these corresponding to three of the four digit locations of the display 42 in FIG. 3. The speaker 40 also bears the same reference numeral.

By way of modification, the microprocessor in the embodiment of FIG. 14 is designated by the reference numeral 350, which as previously described is the COP411L microprocessor having eight bidirectional input/output ports which have "tri-state" outputs allowing for connection of these outputs to a data bus shared by other bus drivers, these input/output ports being designated L0–L7. In addition, the microprocessor 350 includes three general purpose outputs (D1–D3) along with two other bi-directional input/output ports (designated G0 and G1). In addition there is a clock input (CKI) and a serial output (S0) as well as the normal terminals for connection to the power source and ground.

A different phototransducer 352 is employed, the phototransducer 352 being of the type designated 2N5777 which includes a photoconductive transistor portion and an amplifier portion in the same configuration. The base of the phototransducer portion is connected in series with a capacitor 354, the other end of which is connected to the emitter of the amplifier portion 352*b* of the phototransducer 352. The emitter is also collected to the G0 input of the microprocessor 350 with a capacitor 356 coupled thereto with the other end of the capacitor 356 connected to ground. The value of capacitor 354 is 0.01 microfarad while the value of capacitor 356 may be 0.1 microfarad. The common collector of the phototransducer 352 is coupled to lead 358 which essentially provides the positive voltage required for the circuit. This positive voltage results from a suitable power source such as a battery 360 which is coupled through a switch 362 through a diode 364 to lead 358. To prevent transient currents during switching, a capacitor 366 is connected between the cathode of the diode 364 and ground.

A resistor 368 is connected between the positive voltage source lead 358 and the clock input of the microprocessor 350, this resistor having a value of approximately 51,000 ohms. A capacitor 370 (100 picofarads) is connected between the clock input and ground. The voltage supply terminal (VCC) of the microprocessor 350 is connected via lead 372 to lead 358 and similarly the ground GND terminal is connected to circuit ground.

Eight resistors 373–380 (each being 33,000 ohms) are coupled between the positive voltage source lead 358 and the bidirectional input/output ports L7–L0 respectively for use as pull-up resistors for the switches 24, 26, 28, 30, 32, 34 and 36.

The first seven of the input/output ports L0–L6 are electrically connected to each of the digit locations 87–89 with six of these input/output ports L1–L6 also being connected for switching functions. For example, the input/output port L1 is connected to one end of the range select switch 24 with the other end thereof being coupled to a common lead 381 which is connected to the input/output port G1. Similarly the second and third range select switches 26 and 28 have one end thereof coupled to the input/output ports L2 and L3 with the other ends thereof being connected to lead 381. The "fire" switch 32 has one end thereof coupled to the input/output port L4 and the other end thereof coupled to lead 381 while the "repel" switch 30 has one end thereof coupled to the input/output port L5 and the other end thereof coupled to lead 381. The "search" switches 34 and 36 are coupled in series with one end of the series connection being coupled to input/output port L6 and the other end thereof coupled to lead 381.

With respect to the digit locations 87–89 the seven leads coupled thereto provide means for actuation of one or more of the seven segments of the display while digit selection is accomplished over leads 382–384 inclusive which transmit digit select signals from the outputs D1–D3 to the digit locations 87–89 respectively. In the present embodiment, a green light emitting diode 386 is connected between input/output port L7 and lead 384 for selective energization as required by the microprocessor 350 during play of the game to indicate the occurrence of a certain event.

With the particular configuration of microprocessor 350 utilized in the instant embodiment, the leads coupled to the "tri-state" bidirectional input/output ports L0–L7 act as a data bus, with this data bus being connected to the other components such as resistors 373–380; digit locations 87–89; and switches 24, 26, 28, 30, 32, 34 and 36 with the microprocessor 350 selectively inputting or outputting on a timeshared basis to the various components under control of the program within the microprocessor 350.

By utilization of the serial output (S0) of the microprocessor 350 coupled to lead 390, the base of a switching transistor (2N2222) 392 can be used to effect sounds under control of the program within the microprocessor 350. For this purpose the collector of transistor 392 is coupled through a resistor 394 (3,300 ohms) to the positive voltage source lead 358, with the collector also being coupled to one terminal of the speaker 40, the other terminal of which is grounded. The emitter of transistor 392 is likewise grounded with the transistor 392 being in a grounded-emitter configuration.

Functionally, the configuration of the alternate embodiment of FIG. 14 performs the same functions, with minor differences, of the configuration of the embodiment of FIG. 3. A simplified single slope analog-to-digital converter is employed in FIG. 14.

The resistors 373–380 are "pull-up" resistors, these resistors being placed in the circuit when one of the switches is depressed to provide current on the appropriate lead to pull the line "high" when the line circuit is completed by depression of one or more of the switches back to the microprocessor over lead 381 to the input/output port G1.

With respect to the clock input (CKI), the microprocessor 350 requires an external resistor and capacitor to set the oscillator frequency and the purpose of resistor 368 and capacitor 370 are to preset the oscillator frequency.

The phototransducer 352 in FIG. 14 is a Darlington photosensitive light source which is essentially a current source wherein the amount of current passing therethrough depends on the amount of light impinging. The more light impinging, the more current. The capacitor 354 is a filter capacitor. This capacitor filters the "flashing" of the light impinging on the photosensitive portion of the transducer 352. For example, flourescent flashes or changes intensity approximately 120 times per second and an incandescent light source changes intensity 60 times per second. The filter 354 smooths out this flashing. The single slope analog-to-digital conversion is accomplished by the capacitor 356 connected to the G0 input/output port.

Internally the program within the microprocessor 350 establishes a reference light sensitivity level by first selecting a random three bit number to establish one of three ranges and then randomly generating a second three bit code to select one of eight levels within that range. The level value and range value are then stored during the alien hunt.

The program then initiates a subroutine for checking the incident or ambient light of the phototransducer 352. The first step in this subroutine is to initiate an output at the G0 port to discharge the capacitor 356 and then to "record" this initiation as the beginning of a charging period for the capacitor 356. The capacitor 356 will then charge up at a rate determined by the amount of light impinging on the phototransducer 352 during that light measurement period.

As is conventional with such logic devices, although an analog input is provided to the port G0, the logic does not recognize a logic level change from "0" to "1" until a certain threshold level is reached. These threshold levels will vary from one microprocessor of a given configuration to another. However, in any event, when the charge on the capacitor 356 reaches this threshold level the timer stops. This time value that is the time to charge, is used as the measure of incident or ambient light. For more light impinging on transducer 352, a shorter charging time for capacitor 356 results. Conversely, for less light a greater charging time and consequently a greater time period value is measured.

This time value is then compared in a table and correlated to a given range (one of three ranges) and level (one of eight levels) predetermined by the program as the reference light level. For example, the time value may be correlated to an amount of light in range 2 level 3, or the like. The program then initiates a comparison with the randomly selected light range and level utilized as a reference.

Additionally, by the use of a relatively inexpensive transistor 392, sound generation is simplified utilizing a conventional rather than a custom microprocessor. Sound generation is effected by the program within the microprocessor 350 periodically initiating signals over lead 390 to affect the output of transistor 392 to produce the desired tones at the speaker 40.

The light emitting diode 386, and its function, may be added to the circuitry of FIG. 3 with this diode being illuminated under control of the program within the microprocessor 350 upon a concurrence of a signal generated as a result of the ambient or incident light on the phototransducer 352 comparing favorably with the reference light range and level determined by the selection, under control of the program within the microprocessor 350. The program within the microprocessor 350 will include substantially all the functions and processing previously described in conjunction with FIGS. 6 through 13 with the following exceptions. The LITE subroutine of FIG. 10 would be modified to exclude the specific line actuations referenced therein to include a range and level reference selection and to include a comparison function. Additionally, the program would be altered in minor respects to accommodate the illumination of the light emitting diode 386 and the sound subroutine, although not described, would be modified to accommodate switching on an external basis through transistor 392 rather than utilizing circuitry internal to the chip. In order to conserve program since the microprocessor 350 has less capacity than the microprocessor 50 of FIG. 3, sound generation would also be simplified. These modifications between the circuitry of FIG. 3 and FIG. 14 would be obvious to one of ordinary skill in the art after having read the description of the configuration of FIG. 3 and will therefore not be described in detail.

In packaging, either of the circuit configurations of FIG. 3 or FIG. 14 may be employed in the housing of the game 20 of FIG. 1 with the switch arrangement thereon being identical for either version. While the configuration of FIG. 3 provides for more levels of reference light intensity, the embodiment of FIG. 14 still provides for a reasonable number of different reference light intensities while still providing the same game play amusement value.

While there has been shown and described a preferred embodiment, it is to be understood that various other adaptations and modifications may be made within the spirit and scope of the invention.

What is claimed is:

1. In a handheld electronic game for simulating search for an invisible being, the combination comprising: means for providing at least one of a visible and audible stimuli;

phototransducer means for sensing incident and ambient light in the direction in which said game is pointed;

means responsive to an output from said phototransducer means for varying said at least one of said visible and audible stimuli for providing clues as to the whereabouts of the being;

means for establishing a reference light level, said means including means for randomly selecting at least one reference light level from said phototransducer means;

manually operable switch means; and means for comparing the reference light level to the light impinging on said phototransducer means and correlating actuation of said switch means with said means for providing at least one of a visible and audible stimuli for further affecting said means for varying the stimulus so provided whereby to indicate to the operator the success or failure of locating the being.

2. The combination according to claim 1 wherein said game provides visible stimuli and includes display means.

3. The combination according to claim 2 wherein said game further includes audible stimuli and includes sound reproducing means.

4. The combination according to claim 1 wherein said means for establishing a reference light level includes means for selecting a reference light intensity within one of at least two light ranges and one of at least two levels within each of said ranges.

5. The combination according to claim 4 wherein said switch means includes at least two manually operable range select switches for enabling operator selection of a range in accordance with the operator interpretation of said at least one visible and audible stimuli.

6. The combination according to claim 5 wherein said display means includes a numeric display for displaying a value indicative of an amount of energy available to the operator.

7. The combination according to claim 6 wherein said switch means includes at least two other switches.

8. In a handheld electronic game for simulating search for an invisible being, the combination comprising:

a portable housing;

display means on said housing;

switch means on said housing;

phototransducer means on said housing for sensing light in the direction in which said housing is pointed;

electronic means within said housing electrically interconnecting said switch means, said display means and said phototransducer means, said electronic means including:

(a) means for providing a numerical value on said display means;

(b) means for randomly generating one of a plurality of predetermined reference light levels;

(c) means for comparing the so-selected reference light level with light impinging on said phototransducer means in response to actuation of said switch means;

(d) timer means; and (e) means for varying the numerical value on said display means in response to at least one of said timer means and actuation of said switch means.

9. The combination according to claim 8 wherein said electronic means includes microprocessor means.

10. The combination according to claim 9 wherein said means for randomly generating one of a plurality of predetermined reference light levels is within said microprocessor means.

11. The combination according to claim 10 wherein said means for comparing is within said microprocessor means.

12. The combination according to claim 11 wherein said microprocessor means include means for establishing a predetermined numerical value on said display means and means for altering said numerical value in accordance with the sequence and timing of actuation of said switch means.

13. In a manipulatable electronic game for simulating search for an invisible being, the combination comprising:

display means;

a plurality of manually operable switch means;

means for emitting audible signals;

means responsive to actuation of a first of said switch means for providing a numeric value on said display means and for initiating an audible signal;

phototransducer means for sensing light in the direction in which said game is pointed;

means responsive to cessation of actuation of said second switch means for varying the numerical value on said display means;

means for periodically comparing said reference light signal with a light signal from said phototransducer means; and means responsive to the comparison of said signals and to actuation of a third switch means for varying at least one of the value on said display means and said audible signal whereby to indicate to the operator the success or failure of locating the being; means for establishing a reference light level, said means including means for randomly selecting at least one reference light level from said phototransducer means; and means for comparing the reference light level to the light impinging on said phototransducer means and correlating actuation of said second switch means with said means for providing at least one of a visible and audible stimuli for further affecting said means for varying the stimulus so provided whereby to indicate to the operator the success or failure of locating the being.

14. The combination according to claim 13 wherein the numeric value on said display means in response to actuation of said first of said switch means is indicative of an initial energy level.

15. The combination according to claim 13 further including timer means for establishing a time duration of play of the game.

16. The combination according to claim 15 further including light emitting signal means responsive to said comparing means for initiating a light signal indicative of concurrence of said reference light signal with said light signal from said phototransducer means.

* * * * *